US009487026B2

(12) United States Patent
Yamanaka et al.

(10) Patent No.: US 9,487,026 B2
(45) Date of Patent: Nov. 8, 2016

(54) PRINTING APPARATUS, PRINTING SYSTEM, AND MANUFACTURING METHOD OF PRINTED MATTER

(71) Applicants: Kunihiro Yamanaka, Kanagawa (JP); Junji Nakai, Kanagawa (JP); Yohji Hirose, Ibaraki (JP)

(72) Inventors: Kunihiro Yamanaka, Kanagawa (JP); Junji Nakai, Kanagawa (JP); Yohji Hirose, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/657,946

(22) Filed: Mar. 13, 2015

(65) Prior Publication Data

US 2015/0266312 A1 Sep. 24, 2015

(30) Foreign Application Priority Data

Mar. 18, 2014 (JP) ..... 2014-055481
Nov. 21, 2014 (JP) ..... 2014-237049

(51) Int. Cl.

| | |
|---|---|
| ***B41J 29/38*** | (2006.01) |
| ***B41J 2/01*** | (2006.01) |
| ***B41J 11/00*** | (2006.01) |
| *B41J 2/175* | (2006.01) |

(52) U.S. Cl.

CPC ... *B41J 11/0015* (2013.01); *B41J 2002/17589* (2013.01)

(58) Field of Classification Search

CPC ..... B41J 2002/17589; B41J 11/0015; B41J 2/2114; B41J 11/002; C09D 11/326; C09D 11/40

USPC ..... 347/16, 101, 102

See application file for complete search history.

(56) References Cited

U.S. PATENT DOCUMENTS 9,259,924 B2 * 2/2016 Nakai ..... B41J 2/07
2009/0290007 A1 11/2009 Saitoh et al.

FOREIGN PATENT DOCUMENTS

| | | |
|---|---|---|
| JP | 2009-279796 | 12/2009 |
| JP | 2010-188568 | 9/2010 |
| JP | 4662590 | 1/2011 |

* cited by examiner

*Primary Examiner* — An Do

(74) *Attorney, Agent, or Firm* — Duft Bornsen & Fettig LLP

(57) ABSTRACT

A printing apparatus includes a plasma processing unit that processes a surface of a processing object by using plasma; a recording unit that performs ink jet recording on the surface of the processing object, which has been plasma-processed by the plasma processing unit; a setting unit that sets a print mode of an image to be recorded by the recording unit, the print mode corresponding to the processing object; and a control unit that controls the plasma processing unit to plasma-process the processing object with a plasma energy amount based on the print mode set by the setting unit.

14 Claims, 20 Drawing Sheets

FIG.16

| | | |
|---|---|---|
| RESOLUTION 600 dpi | SMALL DROPLET [pl] | 2.5 |
| | INTERMEDIATE DROPLET [pl] | 6.5 |
| | LARGE DROPLET [pl] | 15 |
| RESOLUTION 1200 dpi | SMALL DROPLET [pl] | 2 |
| | INTERMEDIATE DROPLET [pl] | 4 |
| | LARGE DROPLET [pl] | 6 |

FIG.17

| SIZE OF DROPLET [pl] | TYPE OF PAPER (PLASMA ENERGY [J/cm$^2$]) | | | | | | |
|---|---|---|---|---|---|---|---|
| | PLAIN PAPER A | PLAIN PAPER B | COATED PAPER A | COATED PAPER B | COATED PAPER C | FILM A | FILM B |
| 2 | 0.07 | 0.1 | 0.14 | 0.5 | 1 | 0.07 | 0.14 |
| 2.5 | 0.07 | 0.1 | 0.14 | 0.5 | 1 | 0.07 | 0.14 |
| 4 | 0.08 | 0.12 | 0.7 | 1.4 | 2.8 | 0.08 | 0.16 |
| 6 | 0.08 | 0.12 | 0.7 | 1.4 | 2.8 | 0.08 | 0.16 |
| 6.5 | 0.08 | 0.12 | 0.7 | 1.4 | 2.8 | 0.08 | 0.16 |
| 15 | 0.1 | 0.14 | 1.4 | 2.5 | 5 | 0.1 | 0.2 |

FIG.18

| MODEL | INK SET | PRINT MODE | | | | | TYPE OF PAPER (PLASMA ENERGY [J/cm²]) | | | | | | |
|---|---|---|---|---|---|---|---|---|---|---|---|---|---|
| | | | COLOR / MONO-CHROME | RESOLUTION [dpi] | AVERAGE PRODUCTION SPEED [m/MINUTE] | | PLAIN PAPER A | PLAIN PAPER B | COATED PAPER A | COATED PAPER B | COATED PAPER C | FILM A | FILM B |
| A | CMYK | HIGH SPEED | COLOR | 600×300 | 120 | | 0.11 | 0.15 | 1.5 | 2.5 | 5 | 0.1 | 0.2 |
| | | | MONO-CHROME | | | | 0.1 | 0.12 | 1.2 | 2.2 | 4.4 | 0.1 | 0.2 |
| | | NORMAL | COLOR | 600×600 | 75 | | 0.09 | 0.12 | 1.1 | 1.8 | 3.6 | 0.09 | 0.18 |
| | | | MONO-CHROME | | | | 0.08 | 0.11 | 1 | 1.6 | 3.2 | 0.09 | 0.18 |
| | | HIGH QUALITY | COLOR | 600×1200 | 50 | | 0.08 | 0.1 | 0.7 | 1.4 | 2.8 | 0.08 | 0.16 |
| | | | MONO-CHROME | | | | 0.07 | 0.09 | 0.6 | 1.2 | 2.4 | 0.08 | 0.16 |
| | CMYK, LM, LC | HIGH SPEED | COLOR | 600×300 | 120 | | 0.09 | 0.13 | 1.4 | 2.4 | 4.8 | 0.1 | 0.19 |
| | | | MONO-CHROME | | | | 0.1 | 0.12 | 1.2 | 2.2 | 4.4 | 0.1 | 0.2 |
| | | NORMAL | COLOR | 600×600 | 75 | | 0.08 | 0.11 | 1 | 1.7 | 3.5 | 0.08 | 0.17 |
| | | | MONO-CHROME | | | | 0.08 | 0.11 | 1 | 1.6 | 3.2 | 0.09 | 0.18 |
| | | HIGH QUALITY | COLOR | 600×1200 | 50 | | 0.08 | 0.1 | 0.07 | 1.4 | 2.8 | 0.08 | 0.16 |
| | | | MONO-CHROME | | | | 0.07 | 0.09 | 0.06 | 1.2 | 2.4 | 0.08 | 0.16 |
| | CMYK, Or, Gr, LM, LC | HIGH SPEED | COLOR | 600×300 | 120 | | 0.09 | 0.12 | 1.3 | 2.4 | 4.7 | 0.09 | 0.19 |
| | | | MONO-CHROME | | | | 0.1 | 0.12 | 1.2 | 2.2 | 4.4 | 0.1 | 0.2 |
| | | NORMAL | COLOR | 600×600 | 75 | | 0.08 | 0.11 | 1 | 1.6 | 3.4 | 0.08 | 0.17 |
| | | | MONO-CHROME | | | | 0.08 | 0.11 | 1 | 1.6 | 3.2 | 0.09 | 0.18 |
| | | HIGH QUALITY | COLOR | 600×1200 | 50 | | 0.07 | 0.1 | 0.7 | 1.4 | 2.8 | 0.07 | 0.15 |
| | | | MONO-CHROME | | | | 0.07 | 0.09 | 0.6 | 1.2 | 2.4 | 0.08 | 0.16 |
| B | CMYK | HIGH SPEED | COLOR | 600×600 | 120 | | 0.09 | 0.12 | 1.1 | 1.8 | 3.6 | 0.09 | 0.18 |
| | | | MONO-CHROME | | | | 0.08 | 0.11 | 1 | 1.6 | 3.2 | 0.09 | 0.18 |
| | | NORMAL | COLOR | 1200×600 | 75 | | 0.08 | 0.1 | 0.7 | 1.4 | 2.8 | 0.08 | 0.16 |
| | | | MONO-CHROME | | | | 0.07 | 0.09 | 0.6 | 1.2 | 2.4 | 0.08 | 0.16 |
| | | HIGH QUALITY | COLOR | 1200×1200 | 50 | | 0.07 | 0.1 | 0.7 | 1.4 | 2.8 | 0.07 | 0.15 |
| | | | MONO-CHROME | | | | 0.07 | 0.09 | 0.6 | 1.2 | 2.4 | 0.08 | 0.16 |
| | CMYK, (LM, LC) | HIGH SPEED | COLOR | 600×600 | 120 | | 0.08 | 0.11 | 1 | 1.7 | 3.4 | 0.08 | 0.17 |
| | | | MONO-CHROME | | | | 0.08 | 0.11 | 1 | 1.6 | 3.2 | 0.09 | 0.18 |
| | | NORMAL | COLOR | 1200×600 | 75 | | 0.08 | 0.1 | 0.7 | 1.4 | 2.8 | 0.08 | 0.16 |
| | | | MONO-CHROME | | | | 0.07 | 0.09 | 0.6 | 1.2 | 2.4 | 0.07 | 0.16 |
| | | HIGH QUALITY | COLOR | 1200×1200 | 50 | | 0.07 | 0.1 | 0.7 | 1.4 | 2.8 | 0.07 | 0.15 |
| | | | MONO-CHROME | | | | 0.07 | 0.09 | 0.6 | 1.2 | 2.4 | 0.08 | 0.16 |
| | CMYK OrGr (LM, LC) | HIGH SPEED | COLOR | 600×600 | 120 | | 0.08 | 0.11 | 1 | 1.7 | 3.3 | 0.09 | 0.16 |
| | | | MONO-CHROME | | | | 0.08 | 0.11 | 1 | 1.6 | 3.2 | 0.09 | 0.18 |
| | | NORMAL | COLOR | 1200×600 | 75 | | 0.08 | 0.1 | 0.7 | 1.4 | 2.8 | 0.08 | 0.16 |
| | | | MONO-CHROME | | | | 0.07 | 0.09 | 0.6 | 1.2 | 2.4 | 0.08 | 0.16 |
| | | HIGH QUALITY | COLOR | 1200×1200 | 50 | | 0.07 | 0.1 | 0.7 | 1.4 | 2.8 | 0.07 | 0.15 |
| | | | MONO-CHROME | | | | 0.07 | 0.09 | 0.6 | 1.2 | 2.4 | 0.08 | 0.16 |

FIG.19

| MODEL | INK SET | PRINT MODE | | RESOLUTION [dpi] | AVERAGE PRODUCTION SPEED [m/MINUTE] | NUMBER OF PATHS | TYPE OF PAPER (PLASMA ENERGY [J/cm$^2$]) | | | | | | |
|---|---|---|---|---|---|---|---|---|---|---|---|---|---|
| | | | COLOR / MONO-CHROME | | | | NORMAL PAPER A | NORMAL PAPER B | COATED PAPER A | COATED PAPER B | COATED PAPER C | FILM A | FILM B |
| WIDTH 130 mm | CMKY | DRAFT | COLOR | 600×300 | 1524 | 6 | 0.12 | 0.16 | 1.65 | 2.75 | 5.50 | 0.11 | 0.22 |
| | | | MONO-CHROME | | | | 0.11 | 0.13 | 1.32 | 2.42 | 4.84 | 0.11 | 0.22 |
| | | HIGH SPEED | COLOR | 600×600 | 1481 | 8 | 0.11 | 0.15 | 1.50 | 2.50 | 5.00 | 0.10 | 0.20 |
| | | | MONO-CHROME | | | | 0.10 | 0.12 | 1.20 | 2.20 | 4.40 | 0.10 | 0.20 |
| | | NORMAL | COLOR | 1200×600 | 1270 | 12 | 0.09 | 0.12 | 1.10 | 1.80 | 3.60 | 0.09 | 0.18 |
| | | | MONO-CHROME | | | | 0.08 | 0.11 | 1.00 | 1.60 | 3.20 | 0.09 | 0.18 |
| | | HIGH QUALITY | COLOR | 600×1200 | 508 | 16 | 0.08 | 0.10 | 0.70 | 1.40 | 2.80 | 0.08 | 0.16 |
| | | | MONO-CHROME | | | | 0.07 | 0.09 | 0.60 | 1.20 | 2.40 | 0.08 | 0.16 |
| | CMKY OrGr | DRAFT | COLOR | 600×300 | 1524 | 12 | 0.11 | 0.15 | 1.57 | 2.61 | 5.23 | 0.10 | 0.21 |
| | | | MONO-CHROME | | | | 0.10 | 0.12 | 1.25 | 2.30 | 4.60 | 0.10 | 0.21 |
| | | HIGH SPEED | COLOR | 600×600 | 1481 | 16 | 0.10 | 0.14 | 1.43 | 2.38 | 4.75 | 0.10 | 0.19 |
| | | | MONO-CHROME | | | | 0.10 | 0.11 | 1.14 | 2.09 | 4.18 | 0.10 | 0.19 |
| | | NORMAL | COLOR | 1200×600 | 1270 | 24 | 0.09 | 0.11 | 1.05 | 1.71 | 3.42 | 0.09 | 0.17 |
| | | | MONO-CHROME | | | | 0.08 | 0.10 | 0.95 | 1.52 | 3.04 | 0.09 | 0.17 |
| | | HIGH QUALITY | COLOR | 600×1200 | 508 | 32 | 0.08 | 0.10 | 0.67 | 1.33 | 2.66 | 0.08 | 0.15 |
| | | | MONO-CHROME | | | | 0.07 | 0.09 | 0.57 | 1.14 | 2.28 | 0.08 | 0.15 |
| | CMKYRG +LC+LM | DRAFT | COLOR | 600×300 | 1524 | 12 | 0.11 | 0.14 | 1.49 | 2.48 | 4.96 | 0.10 | 0.20 |
| | | | MONO-CHROME | | | | 0.10 | 0.12 | 1.19 | 2.18 | 4.37 | 0.10 | 0.20 |
| | | HIGH SPEED | COLOR | 600×600 | 1481 | 16 | 0.10 | 0.14 | 1.35 | 2.26 | 4.51 | 0.09 | 0.18 |
| | | | MONO-CHROME | | | | 0.09 | 0.11 | 1.08 | 1.99 | 3.97 | 0.09 | 0.18 |
| | | NORMAL | COLOR | 1200×600 | 1270 | 24 | 0.08 | 0.11 | 0.99 | 1.62 | 3.25 | 0.08 | 0.16 |
| | | | MONO-CHROME | | | | 0.07 | 0.10 | 0.90 | 1.44 | 2.89 | 0.08 | 0.16 |
| | | HIGH QUALITY | COLOR | 600×1200 | 508 | 32 | 0.07 | 0.09 | 0.63 | 1.26 | 2.53 | 0.07 | 0.14 |
| | | | MONO-CHROME | | | | 0.06 | 0.08 | 0.54 | 1.08 | 2.17 | 0.07 | 0.14 |
| WIDTH 160 mm | CMKY | DRAFT | COLOR | 600×300 | 1524 | 6 | 0.13 | 0.17 | 1.73 | 2.89 | 5.78 | 0.12 | 0.23 |
| | | | MONO-CHROME | | | | 0.12 | 0.14 | 1.39 | 2.54 | 5.08 | 0.12 | 0.23 |
| | | HIGH SPEED | COLOR | 600×600 | 1481 | 8 | 0.12 | 0.16 | 1.58 | 2.63 | 5.25 | 0.11 | 0.21 |
| | | | MONO-CHROME | | | | 0.11 | 0.13 | 1.26 | 2.31 | 4.62 | 0.11 | 0.21 |
| | | NORMAL | COLOR | 1200×600 | 1270 | 12 | 0.09 | 0.13 | 1.16 | 1.89 | 3.78 | 0.09 | 0.19 |
| | | | MONO-CHROME | | | | 0.08 | 0.12 | 1.05 | 1.68 | 3.36 | 0.09 | 0.19 |
| | | HIGH QUALITY | COLOR | 600×1200 | 508 | 16 | 0.08 | 0.11 | 0.74 | 1.47 | 2.94 | 0.08 | 0.17 |
| | | | MONO-CHROME | | | | 0.07 | 0.09 | 0.63 | 1.26 | 2.52 | 0.08 | 0.17 |
| | CMKY OrGr | DRAFT | COLOR | 600×300 | 1524 | 12 | 0.12 | 0.16 | 1.65 | 2.74 | 5.49 | 0.11 | 0.22 |
| | | | MONO-CHROME | | | | 0.11 | 0.13 | 1.32 | 2.41 | 4.83 | 0.11 | 0.22 |
| | | HIGH SPEED | COLOR | 600×600 | 1481 | 16 | 0.11 | 0.15 | 1.50 | 2.49 | 4.99 | 0.10 | 0.20 |
| | | | MONO-CHROME | | | | 0.10 | 0.12 | 1.20 | 2.19 | 4.39 | 0.10 | 0.20 |
| | | NORMAL | COLOR | 1200×600 | 1270 | 24 | 0.09 | 0.12 | 1.10 | 1.80 | 3.59 | 0.09 | 0.18 |
| | | | MONO-CHROME | | | | 0.08 | 0.11 | 1.00 | 1.60 | 3.19 | 0.09 | 0.18 |
| | | HIGH QUALITY | COLOR | 600×1200 | 508 | 32 | 0.08 | 0.10 | 0.70 | 1.40 | 2.79 | 0.08 | 0.16 |
| | | | MONO-CHROME | | | | 0.07 | 0.09 | 0.60 | 1.20 | 2.39 | 0.08 | 0.16 |
| | CMKYRG +LC+LM | DRAFT | COLOR | 600×300 | 1524 | 12 | 0.11 | 0.15 | 1.56 | 2.61 | 5.21 | 0.10 | 0.21 |
| | | | MONO-CHROME | | | | 0.10 | 0.12 | 1.25 | 2.29 | 4.59 | 0.10 | 0.21 |
| | | HIGH SPEED | COLOR | 600×600 | 1481 | 16 | 0.10 | 0.14 | 1.42 | 2.37 | 4.74 | 0.09 | 0.19 |
| | | | MONO-CHROME | | | | 0.09 | 0.11 | 1.14 | 2.08 | 4.17 | 0.09 | 0.19 |
| | | NORMAL | COLOR | 1200×600 | 1270 | 24 | 0.09 | 0.11 | 1.04 | 1.71 | 3.41 | 0.09 | 0.17 |
| | | | MONO-CHROME | | | | 0.08 | 0.10 | 0.95 | 1.52 | 3.03 | 0.09 | 0.17 |
| | | HIGH QUALITY | COLOR | 600×1200 | 508 | 32 | 0.08 | 0.09 | 0.66 | 1.33 | 2.65 | 0.08 | 0.15 |
| | | | MONO-CHROME | | | | 0.07 | 0.09 | 0.57 | 1.14 | 2.27 | 0.08 | 0.15 |

FIG.24

| OPTIONS FOR INK TOTAL AMOUNT CONTROL VALUE | PLASMA ENERGY COEFFICIENT (TIMES) |
|---|---|
| LOW | 0.9 |
| NORMAL | 1 |
| HIGH | 1.1 |

FIG.25

| OPTIONS FOR NUMBER OF PATHS | PLASMA ENERGY COEFFICIENT (TIMES) |
|---|---|
| 1/2 TIMES | 2 |
| NORMAL | 1 |
| DOUBLE | 0.5 |

FIG.26

| OPTIONS FOR PRINTING DIRECTION | PLASMA ENERGY COEFFICIENT (TIMES) |
|---|---|
| UNIDIRECTIONAL | 1 |
| BIDIRECTIONAL | 2 |

FIG.27

| OPTIONS FOR IMAGE DENSITY | PLASMA ENERGY COEFFICIENT (TIMES) |
|---|---|
| LOW | 0.8 |
| NORMAL | 1 |
| HIGH | 1.2 |

FIG.28

| OPTIONS FOR CARRIAGE SPEED | PLASMA ENERGY COEFFICIENT (TIMES) |
|---|---|
| NORMAL | 1 |
| DOUBLE SPEED | 2 |

PRINTING APPARATUS, PRINTING SYSTEM, AND MANUFACTURING METHOD OF PRINTED MATTER

CROSS-REFERENCE TO RELATED APPLICATIONS

The present application claims priority to and incorporates by reference the entire contents of Japanese Patent Application No. 2014-055481 filed in Japan on Mar. 18, 2014 and Japanese Patent Application No. 2014-237049 filed in Japan on Nov. 21, 2014.

BACKGROUND OF THE INVENTION

1. Field of the Invention

The present invention relates to a printing apparatus, a printing system, and a manufacturing method of printed matter.

2. Description of the Related Art

Conventional ink jet recording apparatuses mainly use a shuttle method in which a head reciprocates in a width direction of a recording medium that is typically a sheet of paper and a film, so that it is difficult to improve throughput by high-speed printing. Therefore, in recent years, to achieve high-speed printing, a one-path method is proposed in which a plurality of heads are aligned so as to cover the entire width of the recording medium and recording is performed by using these heads at the same time. Conventional techniques are described in Japanese Patent No. 4662590, Japanese Patent Application Laid-open No. 2010-188568, and Japanese Patent Application Laid-open No. 2009-279796.

Although the one-path method is advantageous for high-speed printing, the time interval by which adjacent dots are hit by ink droplets is short and an adjacent dot is hit by an ink droplet before an ink droplet jetted previously permeates into the recording medium. Therefore, there is a problem that adjacent dots are easily merged with each other (hereinafter this phenomenon is referred to as droplet interference) and image quality easily deteriorates.

In view of the above situations, there is a need to provide a printing apparatus, a printing system, and a manufacturing method of printed matter, which can manufacture high-quality printed matter.

SUMMARY OF THE INVENTION

It is an object of the present invention to at least partially solve the problems in the conventional technology.

According to an embodiment, there is provided a printing apparatus including a plasma processing unit that processes a surface of a processing object by using plasma; a recording unit that performs ink jet recording on the surface of the processing object, which has been plasma-processed by the plasma processing unit; a setting unit that sets a print mode of an image to be recorded by the recording unit, the print mode corresponding to the processing object; and a control unit that controls the plasma processing unit to plasma-process the processing object with a plasma energy amount based on the print mode set by the setting unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 16 is a diagram illustrating a correspondence relationship between the resolution and the size of droplet according to the first embodiment;

FIG. 17 is a diagram illustrating a correspondence relationship between the size of droplet, the type of paper, and the plasma energy according to the size of droplet and the type of paper according to the first embodiment;

FIG. 18 is a diagram illustrating an example of a reference table which is for a line type printer and which is created and optimized in the first embodiment;

FIG. 19 is a diagram illustrating an example of a reference table which is for a serial type printer and which is created and optimized in the first embodiment;

FIG. 24 is an adjustment table for an ink total amount control value according to the first embodiment;

FIG. 25 is an adjustment table for the number of paths according to the first embodiment;

FIG. 26 is an adjustment table for a printing direction according to the first embodiment;

FIG. 27 is an adjustment table for an image density according to the first embodiment;

FIG. 28 is an adjustment table for a carriage speed according to the first embodiment;

DETAILED DESCRIPTION OF THE PREFERRED EMBODIMENTS

Figure 1:
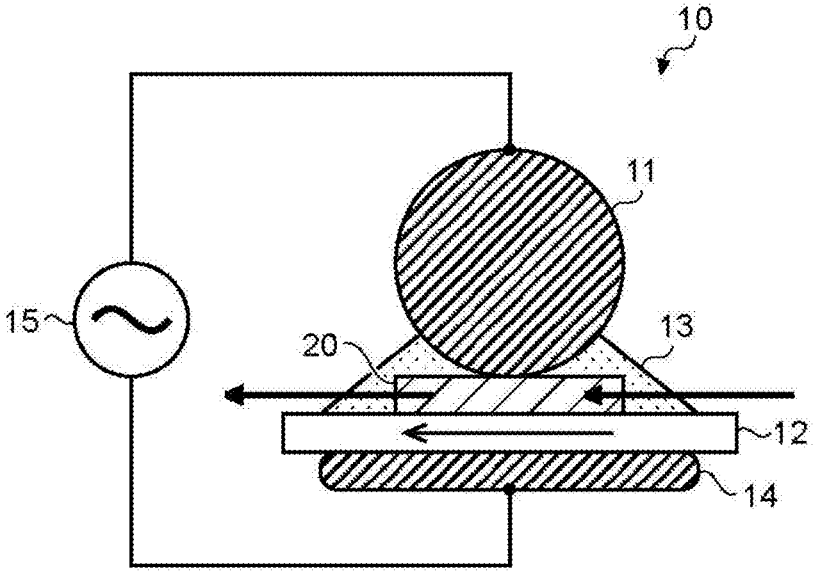
FIG. 1 is a schematic diagram illustrating an example of a plasma processing apparatus for performing plasma processing employed in a first embodiment.

Hereinafter, a preferred embodiment of the present invention will be described in detail with reference to the accompanying drawings. The embodiment described below is a preferred embodiment of the present invention, so that technically preferred various limitations are imposed on the embodiment. However, the scope of the present invention is not unduly limited by the description below, and further not all the components described in the present embodiment are essential components of the present invention.

First Embodiment

First, a printing apparatus, a printing system, and a manufacturing method of printed matter according to a first embodiment will be described in detail with reference to the drawings. The first embodiment has the features described below in order to reform a surface of a processing object and enable to manufacture high quality printed matter.

The first embodiment enables to easily identify an optimal reforming processing condition according to a print mode including the resolution and the like as setting items. Thereby, it is possible to easily manufacture high quality printed matter by reforming the surface of the processing object.

In the first embodiment, it is possible to employ plasma processing as reforming processing of the surface of the processing object. Therefore, before describing the first embodiment, an example of the plasma processing employed in the first embodiment will be described in detail with reference to the drawings. In the plasma processing employed in the first embodiment, polymers in the surface of the processing object are reacted by irradiating the processing object with plasma in the atmosphere and hydrophilic functional groups are formed. Specifically, electrons e discharged from a discharge electrode are accelerated in an electric field and the electrons e excite and ionize atoms and molecules in the atmosphere. Electrons are also discharged from the ionized atoms and molecules and the number of high-energy electrons increases, so that a streamer discharge (plasma) occurs. A polymer binding (a coat layer of coated paper is fixed by calcium carbonate and starch used as a binder, and the starch has a polymer structure) of the surface of the processing object (for example, coated paper) is broken by the high-energy electrons generated by the streamer discharge and the polymers recombine with oxygen radical O*, hydroxyl radical (*OH), and ozone $O_3$. The above processing is called plasma processing. Thereby, polar functional groups such as hydroxyls and carboxyl groups are formed in the surface of the processing object. As a result, a hydrophilic property and an acidic property are given to the surface of the processing object. The surface of the processing object is acidified (pH value lowers) due to increase in the carboxyl groups.

The hydrophilic property of the surface of the processing object increases, so that dots adjacent to each other on the surface of the processing object are wetted and spread to merge with each other. To prevent occurrence of color mixture between dots due to the above phenomenon, it is necessary to quickly aggregate colorant (for example, pigment and dye) within a dot and dry a vehicle or cause the vehicle to permeate the processing object before the vehicle is wetted and spread. The plasma processing illustrated in the above description works as an acidification processing means (step) that acidifies the surface of the processing object, so that the plasma processing can increase the aggregation speed of the colorant within a dot. Also in this point, it is considered that it is effective to perform the plasma processing as preprocessing of ink jet recording processing.

In the first embodiment, it is possible to employ, for example, atmospheric non-equilibrium plasma processing using dielectric barrier discharge as the plasma processing. In acidification processing by the atmospheric non-equilibrium plasma, the electron temperature is very high and the gas temperature is near normal temperature, so that the atmospheric non-equilibrium plasma processing is one of preferred plasma processing methods for a processing object such as a recording medium.

As a method of widely and stably generating the atmospheric non-equilibrium plasma, there is atmospheric non-equilibrium plasma processing that employs dielectric barrier discharge of a streamer dielectric breakdown type. It is possible to obtain the dielectric barrier discharge of the streamer dielectric breakdown type by, for example, applying an alternating high voltage between electrodes coated with a dielectric. However, as a method of generating the atmospheric non-equilibrium plasma, it is possible to use various methods besides the dielectric barrier discharge of the streamer dielectric breakdown type. For example, it is possible to apply a dielectric barrier discharge in which an insulator such as a dielectric is inserted between electrodes, a corona discharge that forms a significantly non-uniform electric field in a thin metal wire or the like, a pulse discharge that applies a short pulse voltage, and the like. Further, it is possible to combine two or more of these methods.

FIG. 1 is a schematic diagram of an example of a plasma processing apparatus for performing the plasma processing employed in the first embodiment. As illustrated in FIG. 1, for the plasma processing employed in the first embodiment, it is possible to use a plasma processing apparatus 10 including a discharge electrode 11, a counter electrode (also referred to as a grounding electrode) 14, a dielectric 12, a high frequency high voltage power supply 15. In the plasma processing apparatus 10, the dielectric 12 is arranged between the discharge electrode 11 and the counter electrode 14. The discharge electrode 11 and the counter electrode 14 may be an electrode whose metallic portion is exposed or may be an electrode coated with a dielectric or an insulator of insulation rubber, ceramic, or the like. The dielectric 12 arranged between the discharge electrode 11 and the counter electrode 14 may be an insulator of polyimide, silicon, ceramic, or the like. When the corona discharge is employed as the plasma processing, the dielectric 12 may be omitted. However, for example, when the dielectric barrier discharge is employed, it may be preferable to provide the dielectric 12. In this case, it is possible to more efficiently improve the effect of plasma processing when the dielectric 12 is arranged near or in contact with the counter electrode 14 than the case when the dielectric 12 is arranged near or in contact with the discharge electrode 11 because when the dielectric 12 is arranged near or in contact with the counter electrode 14, the area of creeping discharge increases. The discharge electrode 11 and the counter electrode 14 (or the dielectric 12 of an electrode that is provided with the dielectric 12) may be arranged at a position in contact with a processing object 20 that passes through between the two electrodes or may be arranged at a position not in contact with the processing object 20.

The high frequency high voltage power supply 15 applies a high frequency and high voltage pulse voltage between the discharge electrode 11 and the counter electrode 14. The voltage value of the pulse voltage is, for example, about 10 kV (kilovolt) (p-p). The frequency of the pulse voltage can be, for example, about 20 kHz (kilohertz). When such a high frequency and high voltage pulse voltage is supplied between the two electrodes, an atmospheric non-equilibrium plasma 13 is generated between the discharge electrode 11 and the dielectric 12. The processing object 20 passes through between the discharge electrode 11 and the dielectric 12 while the atmospheric non-equilibrium plasma 13 is being generated. Thereby, the surface of the processing object 20 facing the discharge electrode 11 is plasma-processed.

In the plasma processing apparatus 10 illustrated in FIG. 1, a rotary type discharge electrode 11 and a belt conveyer type dielectric 12 are employed. The processing object 20 is sandwiched and conveyed between the rotating discharge electrode 11 and the dielectric 12, so that the processing object 20 passes through the atmospheric non-equilibrium plasma 13. Thereby, the surface of the processing object 20 comes into contact with the atmospheric non-equilibrium plasma 13 and uniform plasma processing is applied to the surface of the processing object 20. However, the plasma processing apparatus employed in the first embodiment is not limited to the configuration illustrated in FIG. 1. For example, the plasma processing apparatus may have various modified configurations such as a configuration in which the discharge electrode 11 is close to the processing object 20 without coming into contact with the processing object 20 and a configuration in which the discharge electrode 11 is mounted on a carriage where an ink jet head is mounted. Besides the belt conveyer type dielectric 12, a flat plate type dielectric 12 can be employed.

Figure 2:
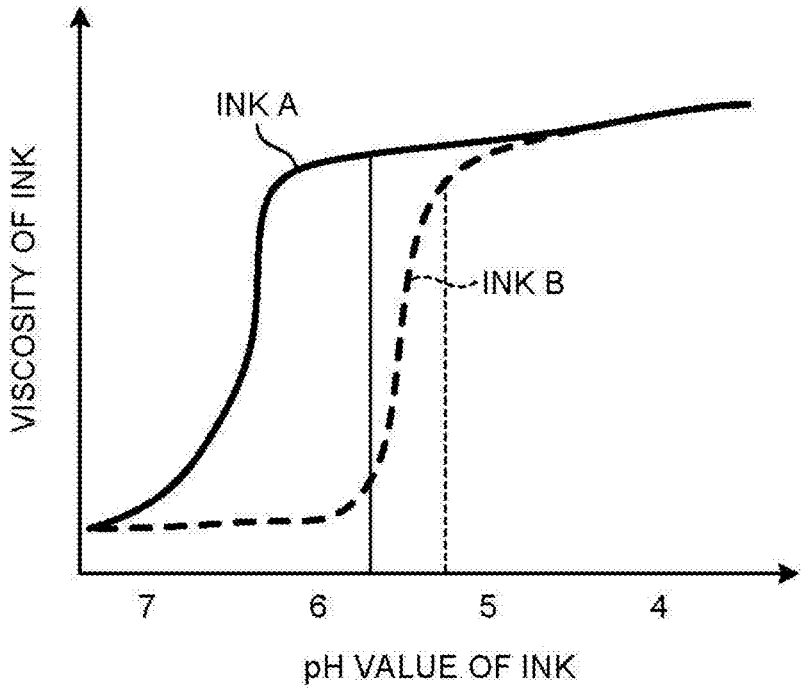
FIG. 2 is a diagram illustrating an example of a relationship between a pH value of ink and the viscosity of ink in the first embodiment.

The acidification in the present description means to lower the pH value of a surface of a print medium to a pH value at which the pigment contained in an ink aggregate. To lower the pH value is to increase the concentration of hydrogen ion H+ in an object. The pigment in the ink before the ink comes into contact with the surface of the processing object is negatively charged and dispersed in a liquid such as a vehicle. FIG. 2 illustrates an example of a relationship between the pH value of the ink and the viscosity of the ink. As illustrated in FIG. 2, as the pH value of the ink decreases, the viscosity of the ink increases. This is because more pigments that are negatively charged in the vehicle of the ink are electrically neutralized as the acidity of the ink increases, and as a result, the pigments aggregate. Therefore, it is possible to increase the viscosity of the ink by, for example, lowering the pH value of the surface of the print medium so that the pH value of the ink becomes a value corresponding to a required viscosity in the graph illustrated in FIG. 2. This is because when the ink is attached to the print medium surface which is acidic, the pigment is electrically neutralized by the hydrogen ions H+ in the print medium surface, and as a result, the pigment aggregates. Thereby, it is possible to prevent color mixture between adjacent dots and to prevent the pigment from permeating the print medium deeply (further, to the back surface). However, to lower the pH value of the ink to a pH value corresponding to a required viscosity, it is necessary to set the pH value of the surface of the print medium to lower than the pH value of the ink corresponding to the required viscosity.

The pH value to obtain the required viscosity of the ink varies depending on the characteristics of the ink. Specifically, while there is an ink where the pigment aggregates and the viscosity increases at a pH value relatively near neutral as illustrated by the ink A in FIG. 2, there is an ink where a pH value lower than that of the ink A is required to cause the pigment to aggregate as illustrated by the ink B having characteristics different from those of the ink A.

The behavior in which the colorant aggregates in a dot, the drying speed of vehicle, and the permeating speed of vehicle into the processing object vary depending on the size of liquid droplet that varies according to the size of dot (small droplet, intermediate droplet, and large droplet) and the type of the processing object. Therefore, in the first embodiment, the plasma energy amount in the plasma processing may be controlled to an optimal value according to the type of the processing object and a print mode (the size of liquid droplet).

Figure 3:
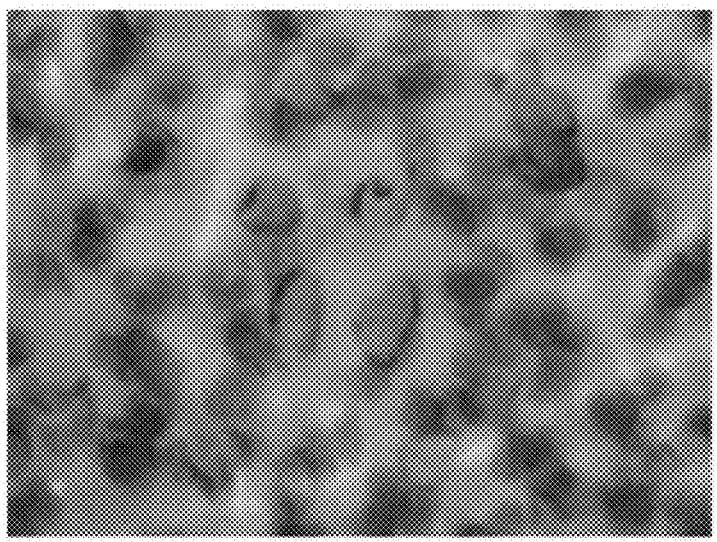
FIG. 3 is an enlarged view of an image obtained by capturing an image of an image forming surface of a printed matter obtained by performing ink jet recording processing on a processing object to which the plasma processing according to the first embodiment is not applied.
Figure 4:
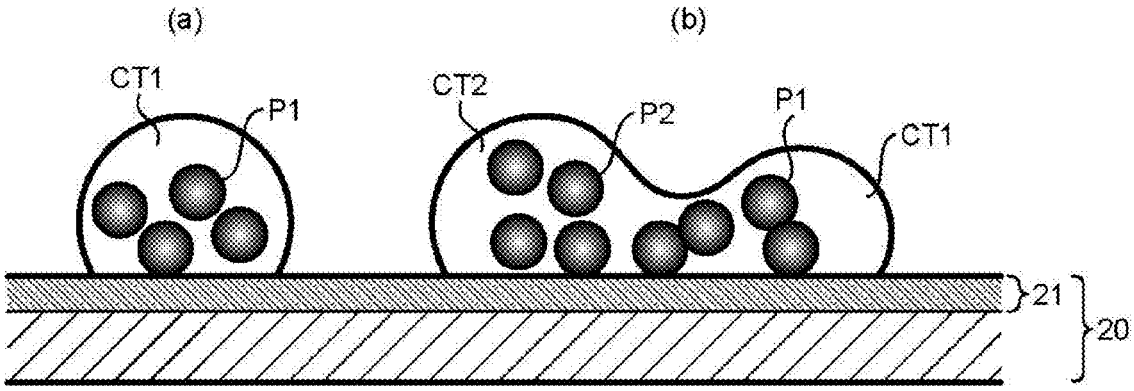
FIG. 4 is a schematic diagram illustrating an example of dots formed on the image forming surface of the printed matter illustrated in FIG. 3.
Figure 5:
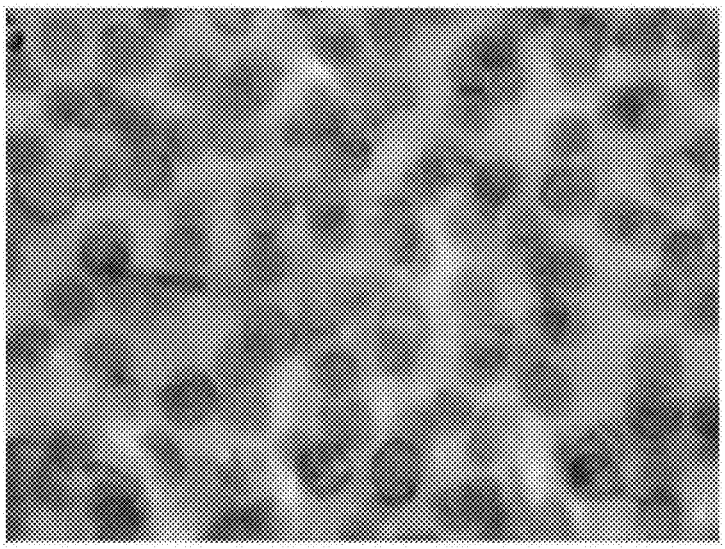
FIG. 5 is an enlarged view of an image obtained by capturing an image of an image forming surface of a printed matter obtained by performing ink jet recording processing on a processing object on which the plasma processing according to the first embodiment is performed.
Figure 6:
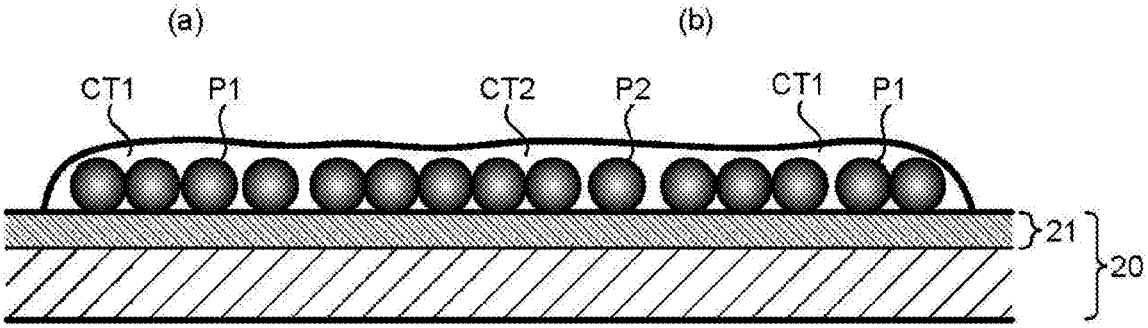
FIG. 6 is a schematic diagram illustrating an example of dots formed on the image forming surface of the printed matter illustrated in FIG. 5.

Here, a difference between a printed matter to which the plasma processing according to the first embodiment is applied and a printed matter to which the plasma processing according to the first embodiment is not applied will be described with reference to FIGS. 3 to 6. FIG. 3 is an enlarged view of an image obtained by capturing an image of an image forming surface of a printed matter obtained by performing ink jet recording processing on a processing object to which the plasma processing according to the first embodiment is not applied. FIG. 4 is a schematic diagram illustrating an example of dots formed on the image forming surface of the printed matter illustrated in FIG. 3. FIG. 5 is an enlarged view of an image obtained by capturing an image of an image forming surface of a printed matter obtained by performing ink jet recording processing on a processing object to which the plasma processing according to the first embodiment is applied. FIG. 6 is a schematic diagram illustrating an example of dots formed on the image forming surface of the printed matter illustrated in FIG. 5. A desktop-type ink jet recording apparatus is used to obtain the printed matters illustrated in FIGS. 3 and 5. As the processing object 20, a normal coated paper including a coat layer 21 is used.

Regarding a coated paper to which the plasma processing is not applied, the wettability of the coat layer 21 located at the surface of the coated paper is not good. Therefore, in an image formed on a coated paper, to which the plasma processing is not applied, by the ink jet recording processing, for example, as illustrated in FIGS. 3 and 4, the shape of the dot (the shape of the vehicle CT1) that is attached to the surface of the coated paper when the dot lands is distorted. Further, when adjacent dots are formed in a state in which the dots are not sufficiently dried, as illustrated in FIGS. 3 and 4, the vehicles CT1 and CT2 are merged when the adjacent dots land on the coated paper, and thereby the pigment P1 and the pigment P2 move (color mixture occurs) between the dots. As a result, density unevenness due to the beading or the like may occur.

On the other hand, regarding a coated paper to which the plasma processing according to the first embodiment is applied, the wettability of the coat layer 21 located at the surface of the coated paper is improved. Therefore, in an image formed on a coated paper, to which the plasma processing is applied, by the ink jet recording processing, for example, as illustrated in FIG. 5, the vehicle CT1 spreads on the surface of the coated paper in a relatively flat perfect circular shape. Thereby, the dot has a flat shape as illustrated in FIG. 6. Further, the surface of the coated paper is acidified by polar functional groups formed by the plasma processing, so that the ink pigment is electrically neutralized and the pigment P1 aggregates to increase the viscosity of the ink. Thereby, even when the vehicle CT1 and CT2 are merged as illustrated in FIG. 6, the movement (color mixture) of the pigment P1 and the pigment P2 between the dots is suppressed. Further, the polar functional groups are also formed in the coat layer 21, so that the permeability of the vehicle CT1 increases. Thereby, the dots can be dried in a relatively short time. A dot that spreads in a perfect circular shape due to increase in wettability aggregates while permeating, so that the pigment P1 is uniformly aggregated in the height direction and it is possible to suppress the density unevenness due to the beading or the like. FIGS. 4 and 6 are schematic diagrams. In practice, the pigment aggregates in layers even in the case of FIG. 6.

In this way, in the processing object 20 to which the plasma processing according to the first embodiment is applied, the hydrophilic functional groups are generated in the surface of the processing object 20, so that the wettability is improved. Further, the surface roughness of the processing object 20 is increased by the plasma processing. As a result, the wettability of the surface of the processing object 20 is further improved. The surface of the processing object 20 is acidified as a result of formation of the polar functional groups by the plasma processing. By these, the landed ink uniformly spreads on the surface of the processing object 20, and the negatively charged pigment is neutralized on the surface of the processing object 20, so that the pigment aggregates and the viscosity increases. As a result, even when dots are merged eventually, it is possible to suppress the movement of the pigment. Further, the polar functional groups are also formed in the coat layer 21 formed on the surface of the processing object 20, so that the vehicle quickly permeates inside the processing object 20, and thereby it is possible to shorten the drying time. In other words, the dot that spreads in a perfect circular shape due to increase in wettability permeates in a state in which the movement of the pigment is suppressed by the aggregation, so that the dot can keep the shape close to a perfect circle.

Figure 7:
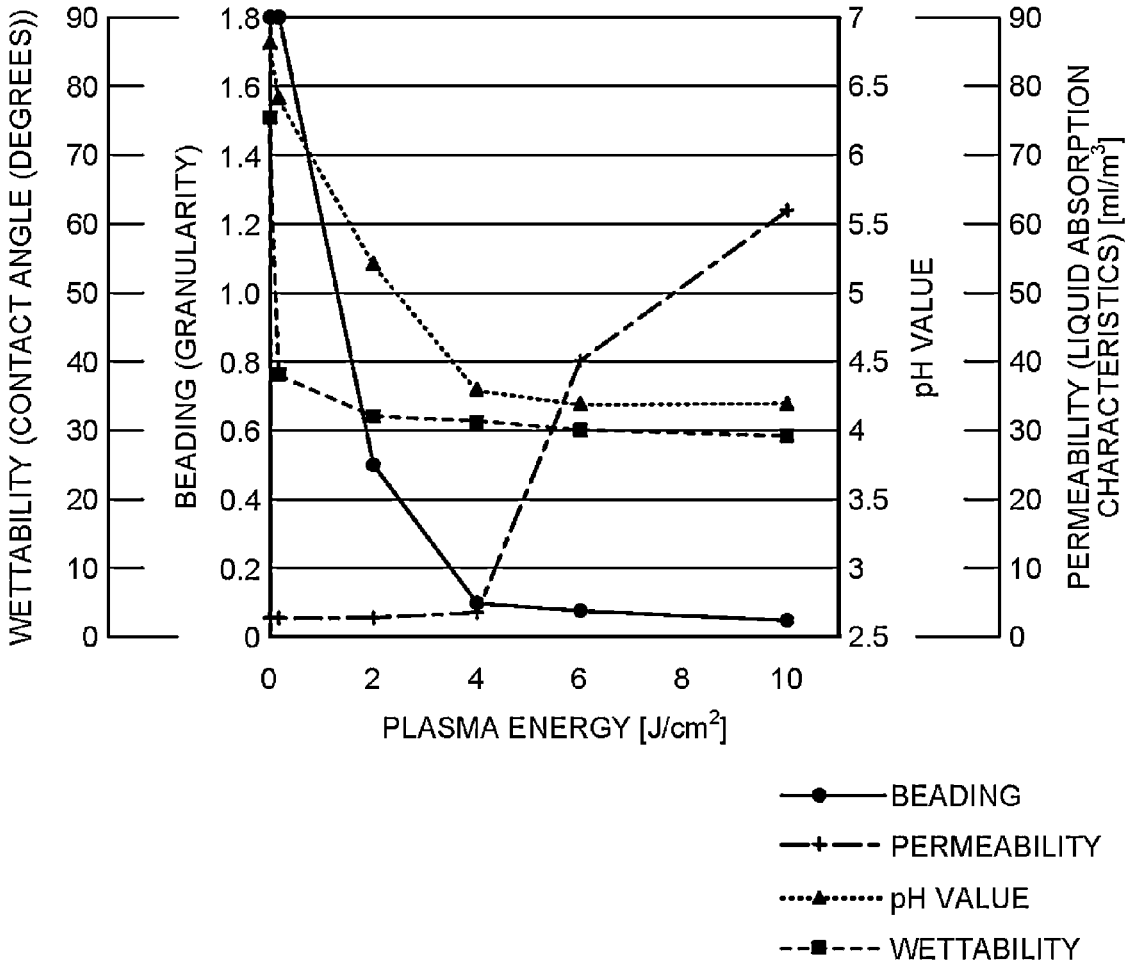
FIG. 7 is a graph illustrating a relationship between the plasma energy, and the wettability, the beading, a pH value, and the permeability of a surface of a processing object according to the first embodiment.

FIG. 7 is a graph illustrating a relationship between the plasma energy and the wettability, the beading, the pH value, and the permeability of the surface of the processing object according to the first embodiment. FIG. 7 illustrates how the surface characteristics (the wettability, the beading, the pH value, and the permeability (liquid absorption characteristics)) of a coated paper change depending on the plasma energy amount when printing is performed on the coated paper used as the processing object 20. When obtaining the evaluation illustrated in FIG. 7, an aqueous pigment ink (an alkaline ink in which negatively charged pigment is dispersed) having characteristics where the pigment aggregates by acid is used as an ink.

As illustrated in FIG. 7, the wettability of the surface of the coated paper rapidly improves when the value of the plasma energy amount is low (for example, about 0.2 $J/cm^2$ or less), and the wettability does not improve so much when the energy is increased from about 0.2 $J/cm^2$. On the other hand, the pH value of the surface of the coated paper lowers to some extent by increasing the plasma energy amount. However, the pH value is saturated when the plasma energy amount exceeds a certain value (for example, about 4 $J/cm^2$). The permeability (liquid absorption characteristics) rapidly improves from when the lowering of pH is saturated (for example, about 4 $J/cm^2$). However, this phenomenon varies depending on a polymer component contained in ink.

As described above, regarding a relationship between the characteristics of the surface of the processing object 20 and the quality of image, when the wettability of the surface improves, the circularity of a dot improves. As a reason of this, it is considered that the wettability of the surface of the processing object 20 is improved and homogenized by the increase of surface roughness due to the plasma processing and the hydrophilic polar functional groups generated by the plasma processing. Also it is considered that removal of water repellent factors such as dust, oil, and calcium carbonate on the surface of the processing object 20 by the plasma processing is one of the reasons of the above. In summary, it is considered that the wettability of the surface of the processing object 20 is improved and factors of instability of the surface of the processing object 20 are removed, so that the liquid droplet spreads uniformly in the circumferential direction and the circularity of a dot improves.

When the surface of the processing object 20 is acidified (pH is lowered), the aggregation of ink pigment, the improvement of permeability, and the permeation of vehicle into the coat layer 21, and the like occur. By these, the density of the pigment of the surface of the processing object 20 increases, so that even if dots are merged, it is possible to suppress the movement of the pigment. As a result, mixture of the pigments is suppressed, so that it is possible to uniformly settle and aggregate the pigment on the surface of the processing object. However, the suppression effect of the mixture of the pigments varies depending on the components of the ink and the size of droplet of the ink. For example, when the size of droplet of the ink is small, the mixture of pigments due to merge of dots is difficult to occur as compared with the case when the size of ink droplet is large. This is because when the amount of vehicle is small, the vehicle dries and permeates more quickly and the pigment can be aggregated by a small pH reaction. The effect of the plasma processing varies depending on the type of the processing object 20 and the environment (humidity and the like). Therefore, it is possible to control the plasma energy amount in the plasma processing to an optimal value according to the size of liquid droplet, the type of the processing object 20, the environment, and the like. As a result, the surface reforming effect of the processing object 20 improves, so that it is possible to achieve further power saving.

Figure 8:
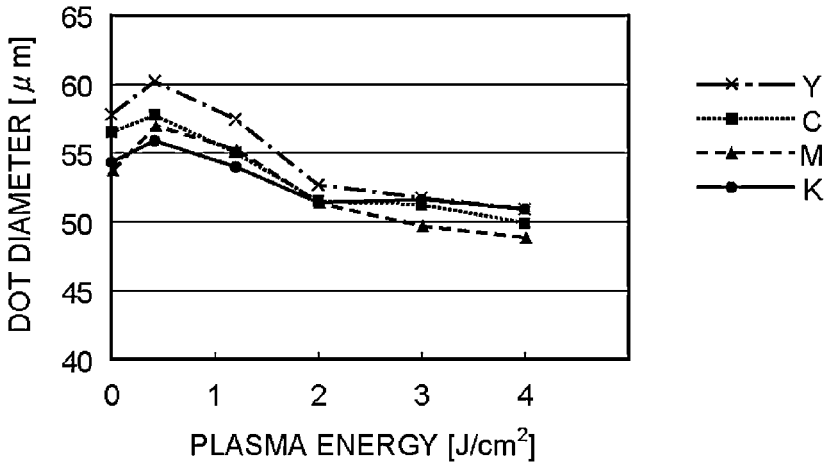
FIG. 8 is a graph illustrating a relationship between the plasma energy and a dot diameter.
Figure 9:
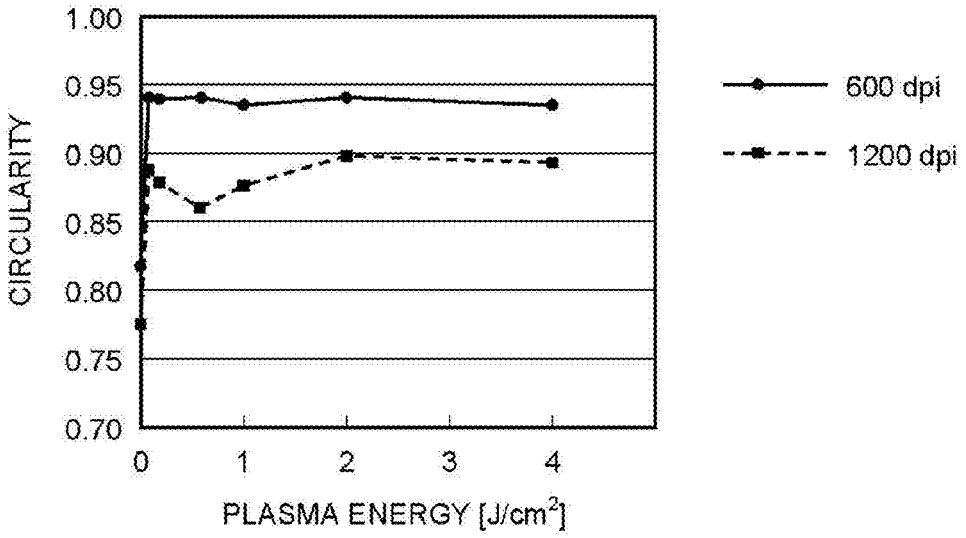
FIG. 9 is a graph illustrating a relationship between the plasma energy and the circularity of a dot according to the first embodiment.
Figure 10:
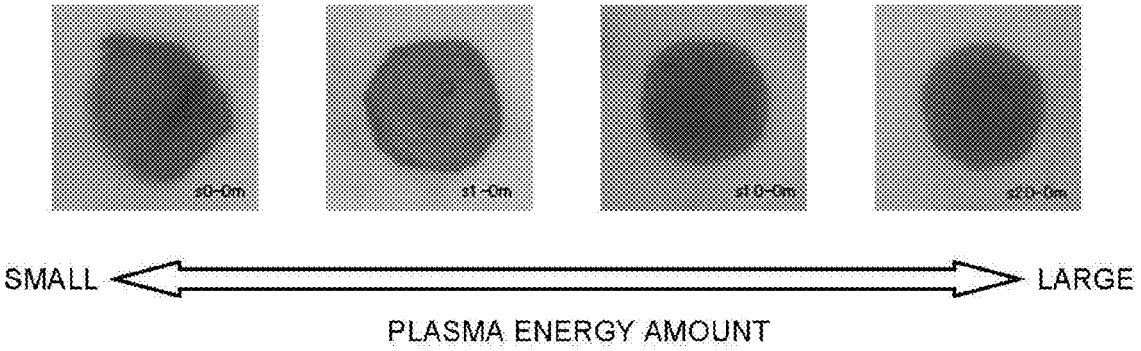
FIG. 10 is a diagram illustrating a relationship between the plasma energy amount and shapes of a dot that is actually formed according to the first embodiment.

Here, a relationship between the plasma energy amount and the circularity of a dot will be described. FIG. 8 is a graph illustrating a relationship between the plasma energy and a dot diameter. FIG. 9 is a graph illustrating a relationship between the plasma energy and the circularity of a dot. FIG. 10 is a diagram illustrating a relationship between the plasma energy amount and shapes of a dot that is actually formed. FIGS. 8 and 10 illustrate a case where an ink of the same type and the same color is used.

As illustrated in FIG. 8, when the plasma energy amount is large, the dot diameter tends to be small for any pigment of CMYK. This is because it is considered that as a result of the plasma processing, the aggregation effect of pigment (increase in viscosity due to aggregation) and the permeability effect (permeation of vehicle into the coat layer 21) are improved and thereby a dot quickly aggregates and permeates in a process in which the dot spreads. It is possible to control the dot diameter by using such effects. In other words, it is possible to control the dot diameter by controlling the plasma energy amount.

As illustrated in FIGS. 9 and 10, the circularity of a dot is significantly improved even when the value of the plasma energy amount is low (for example, about 0.2 J/cm$^2$ or less). This is because it is considered that the viscosity of a dot (vehicle) is increased and the permeability of vehicle is increased by plasma-processing the processing object 20 as described above and thereby the pigment is uniformly aggregated.

Figure 11:
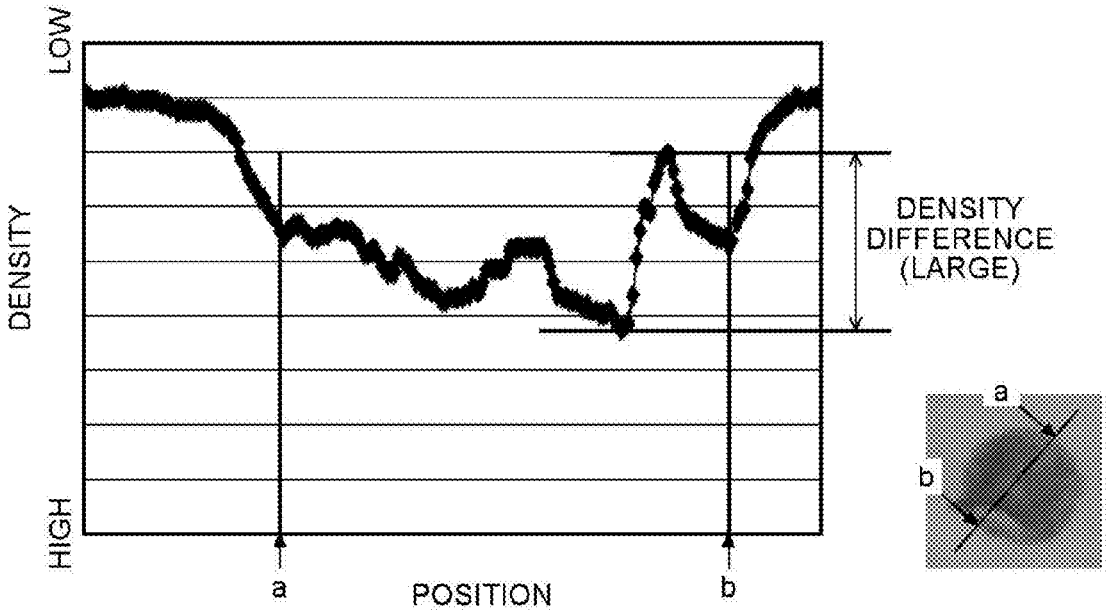
FIG. 11 is a graph illustrating a pigment density in a dot when the plasma processing according to the first embodiment is not performed.
Figure 12:
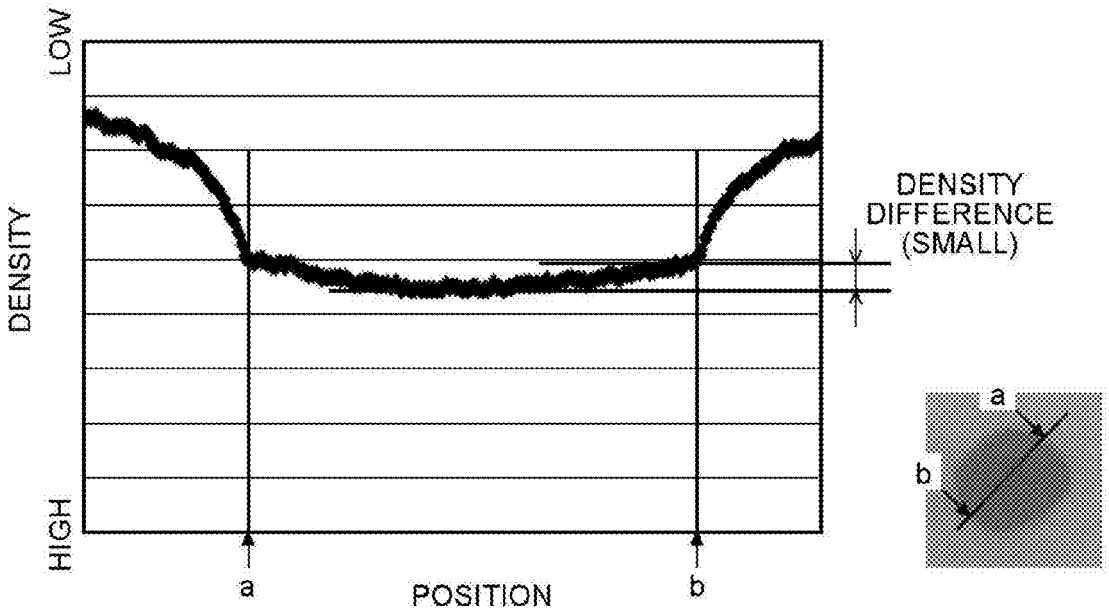
FIG. 12 is a graph illustrating the pigment density in a dot when the plasma processing according to the first embodiment is performed.

A case where the plasma processing is performed for pigment unevenness in a dot and a case where the plasma processing is not performed for pigment unevenness in a dot will be described. FIG. 11 is a graph illustrating the density of a dot when the plasma processing according to the first embodiment is not performed. FIG. 12 is a graph illustrating the density of a dot when the plasma processing is performed. FIGS. 11 and 12 illustrate the density on a line segment a-b in a dot image located at lower right in each figure.

In the measurements of FIGS. 11 and 12, an image of a formed dot is taken, the density of the image is measured, and the variation of the density is calculated. As obvious from the comparison of FIGS. 11 and 12, when the plasma processing is performed (FIG. 12), it is possible to make the variation of the density (density difference) smaller than that when the plasma processing is not performed (FIG. 11). Therefore, the plasma energy amount in the plasma processing may be optimized so as to minimize the variation (density difference) on the basis of the variation of the density obtained by the calculation method as described above. Thereby, it is possible to form a clearer image.

The variation of the density may be calculated not only by the calculation method described above, but also by measuring the thickness of the pigment by using an optical interference film thickness measurement means. In this case, an optimal value of the plasma energy amount may be selected so as to minimize the deviation of the thickness of the pigment.

Next, the printing apparatus, the printing system, the manufacturing method of printed matter, and the program according to the first embodiment will be described in detail with reference to the drawings. In the first embodiment, an image forming apparatus including a discharge head (a recording head or an ink head) of four colors including black (K), cyan (C), magenta (M), and yellow (Y) will be described. However, the discharge head is not limited to the discharge head described above. That is, the image forming apparatus may further include a discharge head using green (G), red (R), and other colors or may include a discharge head using only black (K). In the description below, K, C, M, and Y correspond to black, cyan, magenta, and yellow, respectively.

In the first embodiment, continuous forms rolled into a cylinder shape (hereinafter referred to as a rolled paper) are used as the processing object. However, the processing object is not limited to the rolled paper, but may be a recording medium such as a cut paper on which an image can be formed. When the processing object is paper, as the types of paper, for example, plain paper, high-quality paper, recycled paper, thin paper, thick paper, and coated paper can be used. Further, an object, such as an OHP sheet, a synthetic resin film, a metallic thin film, and the like, on the surface of which an image can be formed by ink or the like, can be used as the processing object. Here, the rolled paper may be continuous forms (continuous form paper or continuous business forms) where perforations are formed at predetermined intervals. In this case, a page in the rolled paper is, for example, a region sandwiched by perforations formed at predetermined intervals.

Figure 13:
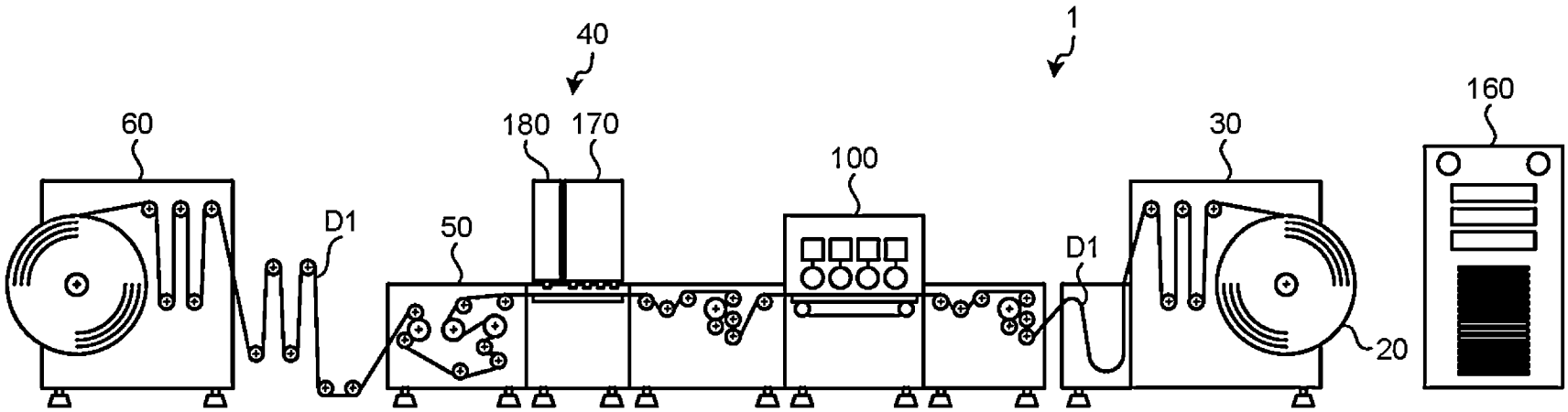
FIG. 13 is a schematic diagram illustrating an outline configuration example of a printing apparatus (system) according to the first embodiment.

FIG. 13 is a schematic diagram illustrating an outline configuration example of the printing apparatus (system) according to the first embodiment. As illustrated in FIG. 13, the printing apparatus (system) 1 includes a carry-in unit 30 that carries in (conveys) the processing object 20 (rolled paper) along a conveyance path D1, a plasma processing apparatus 100 that applies the plasma processing to the carried-in processing object 20 as preprocessing, and an image forming apparatus 40 that forms an image on a surface of the plasma-processed processing object 20. The image forming apparatus 40 can include an ink jet head 170 that forms an image on the plasma-processed processing object 20 by ink jet processing and a pattern reading unit 180 that reads the image formed on the processing object 20. The image forming apparatus 40 may include a post-processing unit that post-processes the processing object 20 on which an image is formed. Further, the printing apparatus (system) 1 may include a drying unit 50 that dries the post-processed processing object 20 and a carry-out unit 60 that carries out the processing object 20 on which an image is formed (and which may be further post-processed). The pattern reading unit 180 may be provided on the downstream side of the drying unit 50 on the conveyance path D1. Further, the printing apparatus (system) 1 may include a control unit 160 that generates raster data from image data for printing and controls each unit in the printing apparatus (system) 1. The control unit 160 can communicate with the printing apparatus (system) 1 through a wired or wireless network. The control unit 160 need not be configured by a single computer and may have a configuration in which a plurality of computers are connected through a network such as LAN (Local Area Network). The control unit 160 may have a configuration including a control unit individually provided to each unit in the printing apparatus (system) 1. When the printing apparatus (system) 1 is configured as a printing system, the control unit 160 may be included in any one of devices.

Each unit (device) illustrated in FIG. 13 may be separated into different housings and configure the printing system 1 as a whole or may be included in the same housing to configure the printing device 1. When the printing apparatus (system) 1 is configured as the printing system 1, the control unit 160 may be included in any one of units and devices.

Next, the printing apparatus (system) 1 according to the first embodiment will be described in more detail. In the printing apparatus (system) 1, a pattern reading unit (the pattern reading unit 180) that acquires an image of formed dots is provided on the downstream side of an ink jet recording unit (the ink jet head 170). The printing apparatus (system) 1 calculates the circularity of a dot, the dot diameter, the variation of the density, and the like by analyzing the acquired image and feedback-controls or feed-forward controls a plasma processing unit (the plasma processing apparatus 100) based on the calculation result.

Figure 14:
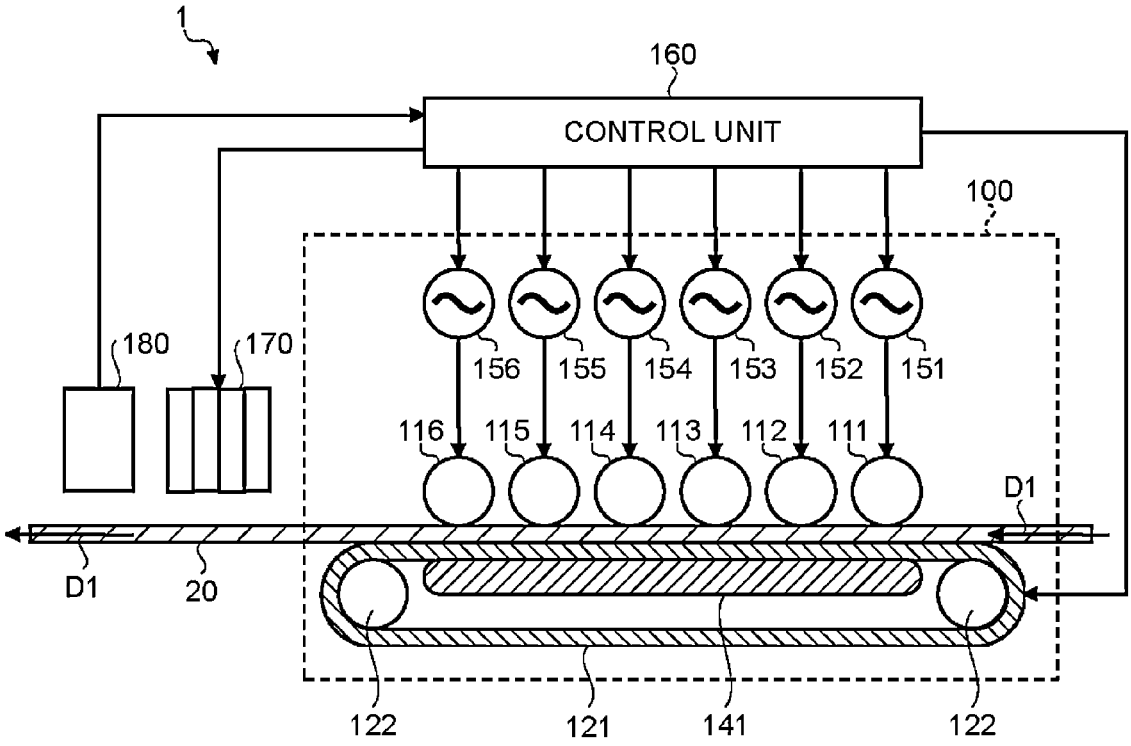
FIG. 14 is a schematic diagram illustrating an outline configuration example of a section from the plasma processing apparatus to a pattern reading unit arranged on the downstream side of an ink jet recording apparatus in the printing apparatus (system) according to the first embodiment.

FIG. 14 illustrates an outline configuration example of a section from the plasma processing apparatus 100 to the pattern reading unit 180 arranged on the downstream side of an ink jet head 170 in the printing apparatus (system) 1 according to the first embodiment. The other components are the same as those in the printing apparatus (system) 1 illustrated in FIG. 13, so that the detailed description will be omitted.

As illustrated in FIG. 14, the printing apparatus (system) 1 includes the plasma processing apparatus 100 arranged on the upstream side of the conveyance path D1, the ink jet head 170 arranged on the downstream side of the plasma processing apparatus 100 on the conveyance path D1, the pattern reading unit 180 arranged on the downstream side of the ink jet head 170, and the control unit 160 that controls each unit in the plasma processing apparatus 100. The ink jet head 170 forms an image by discharging ink to the processing object 20, the surface of which is plasma-processed by the plasma processing apparatus 100 arranged on the upstream side. The ink jet head 170 may be controlled by a control unit arranged separately (not illustrated in the drawings) or may be controlled by the control unit 160.

The plasma processing apparatus 100 includes a plurality of discharge electrodes 111 to 116 arranged along the conveyance path D1, high frequency high voltage power supplies 151 to 156 that supply a high frequency and high voltage pulse voltage to the discharge electrodes 111 to 116, a counter electrode 141 provided in common to the plurality of discharge electrodes 111 to 116, a belt conveyer type endless dielectric 121 arranged as if flowing along the conveyance path D1 between the discharge electrodes 111 to 116 and the counter electrode 141, and a roller 122. The processing object 20 is plasma-processed while being conveyed in the conveyance path D1. When using the plurality of discharge electrodes 111 to 116 arranged along the conveyance path D1, it is preferable that an endless belt is used as the dielectric 121 as illustrated in FIG. 14.

The control unit 160 circulates the dielectric 121 by driving the roller 122. When the processing object 20 is carried in on the dielectric 121 from the upstream carry-in unit 30 (see FIG. 13), the processing object 20 passes through the conveyance path D1 by the circulation of the dielectric 121.

The control unit 160 can individually turn on and off the plurality of high frequency high voltage power supplies 151 to 156. The high frequency high voltage power supplies 151 to 156 respectively supply a high frequency and high voltage pulse voltage to the plurality of discharge electrodes 111 to 116 according to an instruction from the control unit 160.

The pulse voltage may be supplied to all the discharge electrodes 111 to 116 or may be supplied to some of the discharge electrodes 111 to 116. Specifically, the pulse voltage may be supplied to a necessary number of discharge electrodes in order to set the pH value of the surface of the processing object 20 to lower than or equal to a predetermined pH value. Alternatively, the control unit 160 may adjust the plasma energy amount to an amount necessary to set the pH value of the surface of the processing object 20 to lower than or equal to a predetermined pH value by adjusting the frequency and the voltage value of the pulse voltage supplied from each of the high frequency high voltage power supplies 151 to 156. Further, the control unit 160 may adjust the plasma energy amount to the processing object 20 by selecting the number of high frequency high voltage power supplies 151 to 156 to be driven (that is, by selecting the number of discharge electrodes to which the pulse voltage is applied). Further, the control unit 160 may adjust the number of high frequency high voltage power supplies 151 to 156 to be driven and/or the plasma energy amount to be given to each of the discharge electrodes 111 to 116 according to, for example, printing speed information and the type of the processing object 20 (for example, coated paper, PET film, and the like).

Here, as one of methods of obtaining the plasma energy amount required to necessarily and sufficiently plasma-process the surface of the processing object 20, increasing the time of plasma processing can be considered. This can be realized by, for example, slowing the conveyance speed of the processing object 20. However, it is desired to shorten the time of plasma processing to improve the throughput of print processing. As a method of shortening the time of plasma processing, as described above, a method in which a plurality of discharge electrodes 111 to 116 are prepared and a necessary number of discharge electrodes 111 to 116 are driven according to the printing speed and a necessary plasma energy amount, a method of adjusting the plasma energy amount given to the processing object 20 by each of the discharge electrodes 111 to 116, and the like are considered. However, the method is not limited to these methods, but the method can be appropriately changed such as combining these methods or using another method.

Further, providing a plurality of discharge electrodes 111 to 116 is effective to uniformly plasma-process the surface of the processing object 20. Specifically, for example, if the conveyance speed (or the printing speed) is the same, when the plasma processing is performed by a plurality of discharge electrodes, the time in which the processing object 20 passes through the space of plasma can be longer than that when the plasma processing is performed by one discharge electrode. As a result, it is possible to apply the plasma processing more uniformly to the processing object 20.

In FIG. 14, for example, the pattern reading unit 180 captures an image of dots in an image formed on the processing object 20. In the description below, an example will be described in which the captured image is an analysis dot pattern formed in the image.

The image acquired by the pattern reading unit 180 is input into the control unit 160. The control unit 160 calculates the circularity of a dot, the dot diameter, the variation of the density, and the like in the analysis dot pattern by analyzing the input image and adjusts the number of discharge electrodes 111 to 116 to be driven and/or the plasma energy amount of the pulse voltage supplied from each of the high frequency high voltage power supplies 151 to 156 to each of the discharge electrodes 111 to 116 based on the calculation result.

As the ink jet head 170, a plurality of the same color heads (four colors×four heads) may be included. Thereby, it is possible to increase the speed of ink jet recording processing. In this case, for example, to achieve a resolution of 1200 dpi at high speed, the heads of each color in the ink jet head 170 are shifted and fixed so as to correct the intervals between nozzles that discharge ink. Further, a drive pulse of a drive frequency with some variations is input into heads of each color so that the dots of ink discharged from the nozzles correspond to three types of sizes called a small droplet, an intermediate droplet, and a large droplet.

Figure 15:
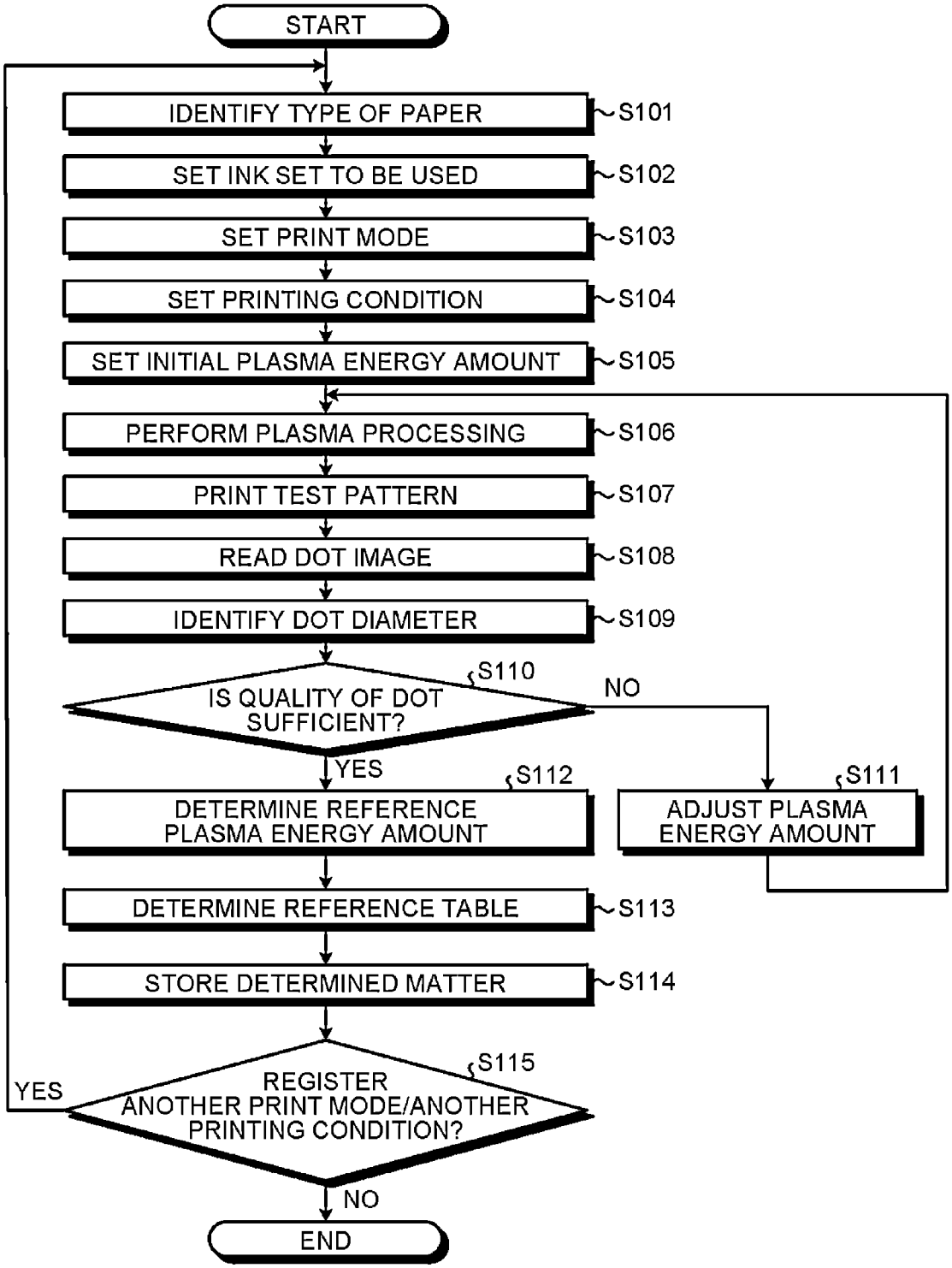
FIG. 15 is a flow chart illustrating an example of processing for creating and optimizing a reference table used in print processing according to the first embodiment and distributing the reference table.

Next, the print processing including the plasma processing according to the first embodiment will be described in detail with reference to the drawings. FIG. 15 is a flow chart illustrating an example of processing for creating and optimizing a reference table used in the print processing according to the first embodiment and distributing the reference table. FIG. 16 is a diagram illustrating a correspondence relationship between the resolution and the size of droplet according to the first embodiment. FIG. 17 is a diagram illustrating a correspondence relationship between the size of droplet, the type of paper, and the plasma energy according to the size of droplet and the type of paper according to the first embodiment. FIG. 18 is a diagram illustrating an example of a reference table which is for a line type printer and which is created and optimized in the first embodiment. FIG. 19 is a diagram illustrating an example of a reference table which is for a serial type printer and which is created and optimized in the first embodiment.

As illustrated in FIG. 15, in the creation/optimization and distribution processing of reference table, the control unit 160 of the printing apparatus (system) 1 first identifies the type of paper (also referred to as a medium brand) of the processing object 20 (step S101) and sets an ink set to be used (hereinafter referred to as a use ink set) (step S102). In the setting of the use ink set, for example, the number of colors to be used, such as a four-color ink set and a six-color ink set, is set. In this case, the brand of the ink to be used and the like may be additionally set. The setting of the use ink set may be input by a user from an input unit not illustrated in the drawings or may be automatically set by the control unit 160 according to a basic setting of image quality and characteristics and the settings of the printing apparatus (for example, the image forming apparatus 40).

Subsequently, the control unit 160 sets a print mode (step S103) and a printing condition (step S104).

In the setting of the print mode (step S103), a setting of a resolution such as 600 dpi and 1200 dpi, a setting of an ink discharge waveform for a variable dot where a plurality of types of size of droplet (size of liquid droplet) such as a large droplet, an intermediate droplet, and a small droplet can be used and for a fixed size of liquid droplet where a fixed size of liquid droplet is used, a setting of a printing apparatus width according to a difference of specification of printing width (for example, 1300 mm and 1600 mm), and the like are performed at the control unit 160. Here, as illustrated in FIG. 16, regarding the correspondence relationship between the resolution and the size of droplet, when the resolution is 600 dpi, the sizes of the large droplet, the intermediate droplet, and the small droplet are, for example, 15 pl (picoliter), 6.5 pl, and 2.5 pl, respectively, and when the resolution is 1200 dpi, the sizes of the large droplet, the intermediate droplet, and the small droplet are, for example, 6 pl, 4 pl, and 2 pl, respectively.

Regarding the setting of each item in the print mode, a user may input the setting of each item from an input unit not illustrated in the drawings, the control unit 160 may provide options such as "high speed", "normal", "high quality", and the like to the user and automatically set each item according to a mode selected from these options, or the control unit 160 may automatically set each item according to a basic setting of image quality and characteristics and the settings of the printing apparatus (for example, the image forming apparatus 40).

In the setting of the printing condition (step S104), the control unit 160 sets, for example, the number of paths, the number of overprintings, a printing direction, a maximum printing apparatus width, a carriage moving speed, an upper limit value of a discharge amount of primary color ink at a print density of 100%, an upper limit value of a discharge amount of secondary color ink at a print density of 100%, an upper limit value of a discharge amount of tertiary color ink at a print density of 100%, and a gamut adjustment (ink mixture ratio).

In the setting of the number of paths, the number of paths into which the ink is divided and discharged is set. In the setting of the number of overprintings, the number of overprintings of the same ink dot is set. In the setting of the printing direction, for example, it is set whether, upon movement in a scanning direction (main-scanning direction) of a carriage on which the ink jet head 170 is mounted in the serial type printer, the ink is discharged when the carriage moves in one direction (forward direction or backward direction) or the ink is discharged when the carriage moves in both directions (forward direction and backward direction). In the setting of the printing apparatus width, a maximum size in the width direction of the processing object 20 that can be set is set. In the setting of the carriage moving speed, for example, a printing speed (high speed or low speed) of a carriage of a serial type printer is set. In the gamut adjustment (ink mixture ratio), an ink mixture ratio of each ink is determined so that the gamut becomes a target gamut.

In the setting of the upper limit value of the discharge amount of primary color ink, for example, the printing density is varied from 0 to 100% and the upper limit value of the discharge amount where printing failure such as beading, bleeding, and feathering does not occur in a solid image of primary color such as yellow, magenta, cyan, and black is set as the upper limit value of the discharge amount of primary color ink at the printing density of 100%. The discharge amount of primary color ink whose printing density is less than 100% is assigned to be equivalent between 0% and 100% of printing density. In the same manner, the upper limit value of the discharge amount of secondary color ink related to green, blue, and red and the upper limit value of the discharge amount of composite black formed from yellow, magenta, and cyan are determined, and the ink discharge amounts of the secondary color and the composite black are assigned to be equivalent between 0% and 100% of printing density. Further, in the same manner, the upper limit value of the discharge amount of tertiary color ink and the ink discharge amount of tertiary color where the ink discharge amount is equivalent between 0% and 100% of printing density are assigned.

The setting of the printing condition may be input by a user from an input unit not illustrated in the drawings or may be automatically set by the control unit 160 according to a basic setting of image quality and characteristics and the settings of the printing apparatus (for example, the image forming apparatus 40).

When the print mode and the printing condition are set as described above, the control unit 160 sets an initial plasma energy amount of the plasma processing performed by the plasma processing apparatus 100 (step S105). The plasma energy amount may be determined by using, for example, a table illustrating a correspondence relationship between the size of droplet, the type of paper, and the plasma energy according to the size of droplet and the type of paper as illustrated in FIG. 17.

Subsequently, the control unit 160 controls the plasma processing apparatus 100 to plasma-process the processing object 20 with the set plasma energy amount (step S106) and then drives the image forming apparatus 40 to print a test pattern on the plasma-processed processing object 20 (step S107). Subsequently, the control unit 160 drives the pattern reading unit 180 to read the printed test pattern (step S108) and then identifies the diameter of a dot (dot diameter) of the printed test pattern by analyzing an image of the read test pattern (step S109).

Subsequently, the control unit 160 determines whether or not the quality of the dot is sufficient based on the identified dot diameter (step S110). However, the index used to determine the quality of the dot is not limited to the dot diameter. For example, the quality of the dot may be determined by using the circularity of the dot or the variation of the density in the dot.

As a result of the determination in step S110, when the quality of the dot is not sufficient (step S110; NO), the control unit 160 adjusts the plasma energy amount of the plasma processing apparatus 100 (step S111) and returns to step S106. For example, when the dot diameter is greater than a target diameter, the control unit 160 brings the plasma energy amount close to an optimal value by increasing the plasma energy amount. On the other hand, for example, when the dot diameter is smaller than the target diameter, the control unit 160 brings the plasma energy amount close to the optimal value by decreasing the plasma energy amount. The method of adjusting the plasma energy amount to the optimal value can be variously modified. For example, it is possible to use a method of increasing or decreasing the currently set plasma energy amount by using a predetermined adjustment value or a method of increasing or decreasing the plasma energy amount by using an adjustment value calculated based on a difference between the identified dot diameter and the target diameter.

On the other hand, when the quality of the dot is sufficient (step S110; YES), the control unit 160 determines the currently set plasma energy amount to be a reference plasma energy amount to be used as a reference in the actual print processing (step S112), creates a reference table, in which a setting used when the actual print processing is performed, is registered by using the reference plasma energy amount (step S113), and stores the table in a memory not illustrated in the drawings (step S114). Thereby, the reference tables illustrated in FIGS. 18 and 19 are created. It is possible to deliver the created and stored reference table to another printing apparatus (system) through a recording medium such as, for example, a USB memory, an SD memory card, a CD, and a DVD and download the created and stored reference table to another printing apparatus (system) through a communication line such as a public line, the Internet, and a LAN (Local Area Network).

Thereafter, the control unit 160 determines whether or not to register another print mode and/or another printing condition (whether or not to create a reference table) (step S115). When the control unit 160 determines to register another print mode and/or another printing condition (step S115; YES), the control unit 160 returns to step S101 and performs the operation of step S101 and the following steps. When the control unit 160 determines not to register another print mode and/or another printing condition (step S115; NO), the control unit 160 ends the present operation. The determination of whether or not to register another print mode and/or another printing condition (whether or not to create a reference table) may be input by a user by using an input unit not illustrated in the drawings or may be automatically determined by the control unit 160 according to a combination of a print mode and a printing condition that are reserved and registered in advance.

In the tables illustrated in FIGS. 17 to 19, instead of the plasma energy amount, the frequency and/or the voltage value of the pulse voltage supplied from each of high frequency high voltage power supplies 151 to 156 and the number of high frequency high voltage power supplies 151 to 156 to be driven (that is, the number of discharge electrodes to which the pulse voltage is applied) may be registered.

Figure 20:
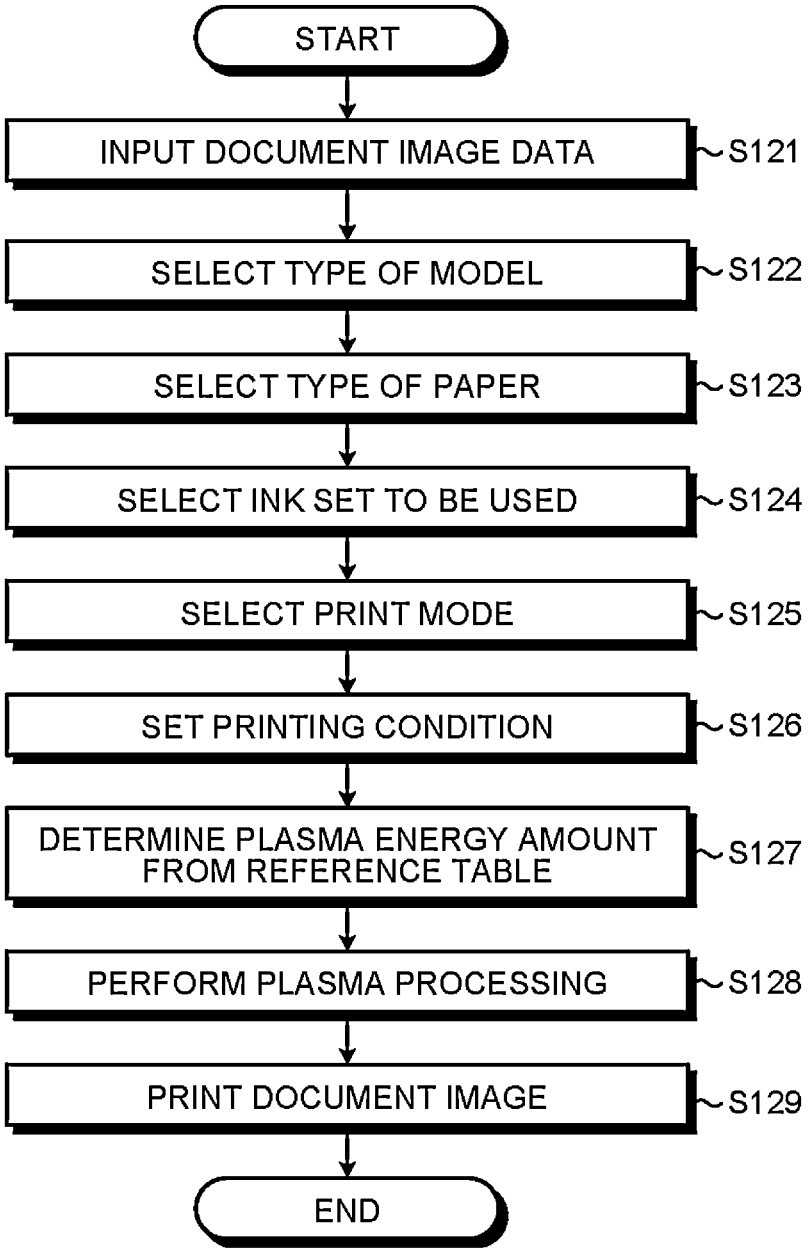
FIG. 20 is a flow chart illustrating an example of a printing operation according to the first embodiment.

Next, a printing operation using the reference table created as described above will be described in detail with reference to a drawing. FIG. 20 is a flow chart illustrating an example of a printing operation according to the first embodiment. As illustrated in FIG. 20, in the actual printing operation, first, the control unit 160 inputs document image data to be printed from outside (step S121). The document image data may be raster data generated by an external RIP (Raster Image Processor). Subsequently, the control unit 160 selects a type of model that performs printing (step S122), selects a type of paper of the processing object 20 on which printing is performed (step S123), and selects an ink set to be used (step S124). The selection of the type of model, the type or paper, and the ink set to be used may be input by a user from an input unit not illustrated in the drawings or may be automatically set by the control unit 160 according to a basic setting of image quality and characteristics and the settings of the printing apparatus (for example, the image forming apparatus 40).

Subsequently, the control unit 160 selects a print mode (step S125). For example, the control unit 160 selects color or monochrome, a resolution, an average production speed of the printing apparatus, and an ink discharge waveform (the size of droplet) as the print mode. The average production speed of the printing apparatus is a parameter related to an average moving speed of the processing object 20 during printing and an average moving speed of the processing object 20 during plasma processing. Regarding the selection of each item in the print mode, a user may select each item from an input unit not illustrated in the drawings, the control unit 160 may provide options such as "high speed", "normal", "high quality", and the like to the user and automatically select each item according to a mode selected from these options, or the control unit 160 may automatically select each item according to a basic setting of image quality and characteristics and the settings of the printing apparatus (for example, the image forming apparatus 40).

Subsequently, the control unit 160 sets a printing condition (step S126). In the same manner as in step S104 in FIG. 15, the setting of the printing condition may be input by a user from an input unit not illustrated in the drawings or may be automatically set by the control unit 160 according to a basic setting of image quality and characteristics and the settings of the printing apparatus (for example, the image forming apparatus 40).

Subsequently, the control unit 160 determines the plasma energy amount to be set in the plasma processing apparatus 100 by referring to the reference table (see FIG. 18 or 19) based on the selected ink set and print mode and the set printing condition (step S127). Thereafter, the control unit 160 performs the plasma processing by using the determined plasma energy amount (step S128), prints the document image on the plasma-processed processing object 20 (step S129), and ends the present operation immediately after the printing is completed.

By the operation as described above, according to the first embodiment, it is possible to easily identify an optimal plasma energy amount according to the print mode, so that high quality printed matter can be easily manufactured.

Figure 21:
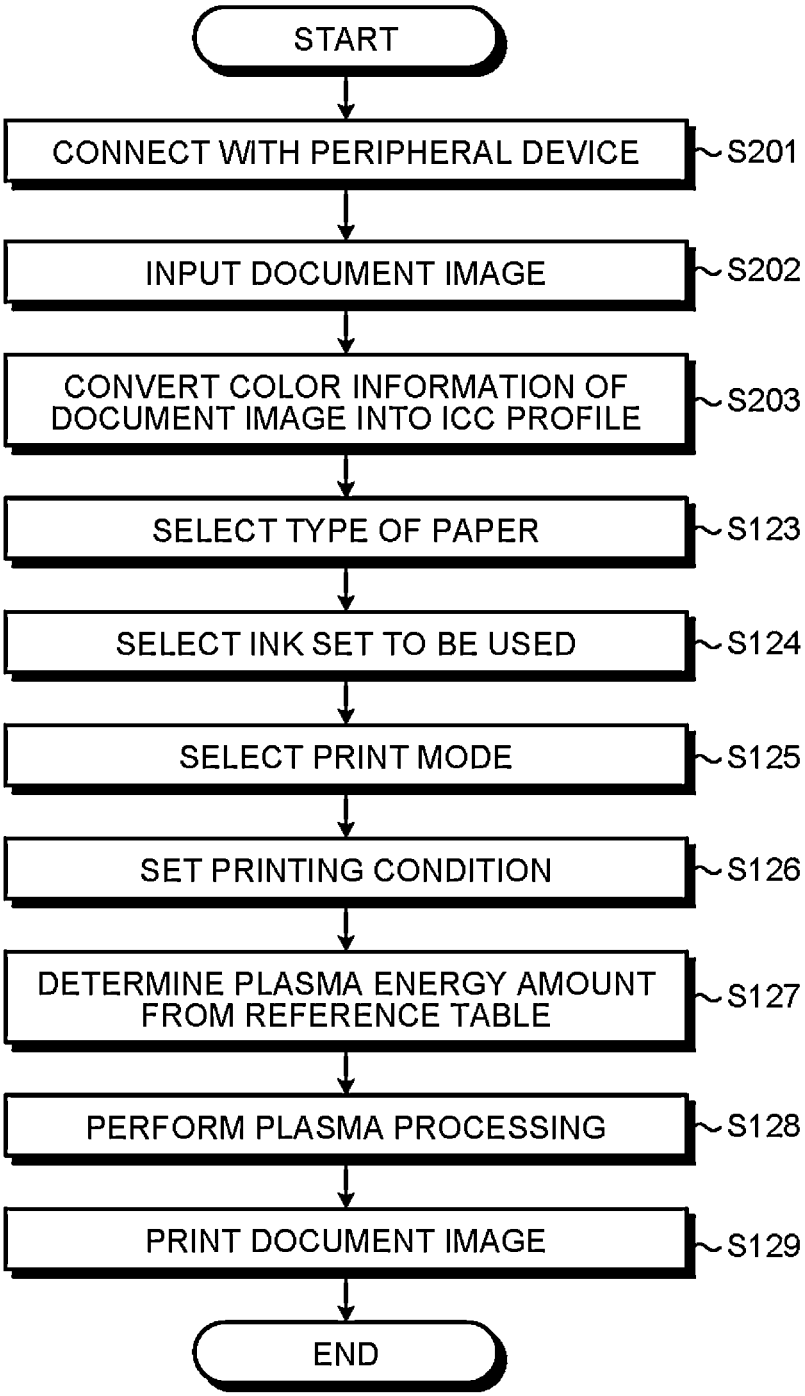
FIG. 21 is a flow chart illustrating another example of the printing operation according to the first embodiment.

Next, another example of the printing operation illustrated in FIG. 20 will be described in detail with reference to a drawing. In FIG. 21, the same processes as those in FIG. 20 are denoted by the same reference numerals and redundant description is omitted.

FIG. 21 is a flow chart illustrating another example of the printing operation according to the first embodiment. As illustrated in FIG. 21, in the printing operation, first, the control unit 160 detects that a device such as a personal computer, a scanner, or a camera is connected to the printing apparatus (system) 1, and identifies the type of model of the connected device (step S201). The connection of the device to the printing apparatus (system) 1 is manually performed by a user. The connection of the device and the identification of the type of model of the connected device may be automatically recognized by the control unit 160 or may be input by a user from an input unit not illustrated in the drawings. When a personal computer is connected, the personal computer inputs image data (a document image to be printed) in which an ICC profile is embedded into the printing apparatus (system) 1.

Subsequently, the control unit 160 inputs the document image to be printed from the connected device (step S202) and converts color information (for example, RGB values) of the input document image by using the ICC profile (step S203). In this case, the RIP that generates raster data is mounted in the printing apparatus (system) 1.

Thereafter, the control unit 160 sets the type of paper, the use ink set, the print mode, and the printing condition, determines the plasma energy amount from the reference table, and performs the plasma processing and the printing of the document image by performing the same operation as that of steps S123 to S129 in FIG. 20, and then ends the present operation. However, the size of droplet used in the printing of the document image in step S129 is the size of droplet determined from the ICC profile of step S203. Therefore, the plasma energy amount determined in step S127 is the plasma energy amount according to the size of droplet determined from the ICC profile.

Figure 22:
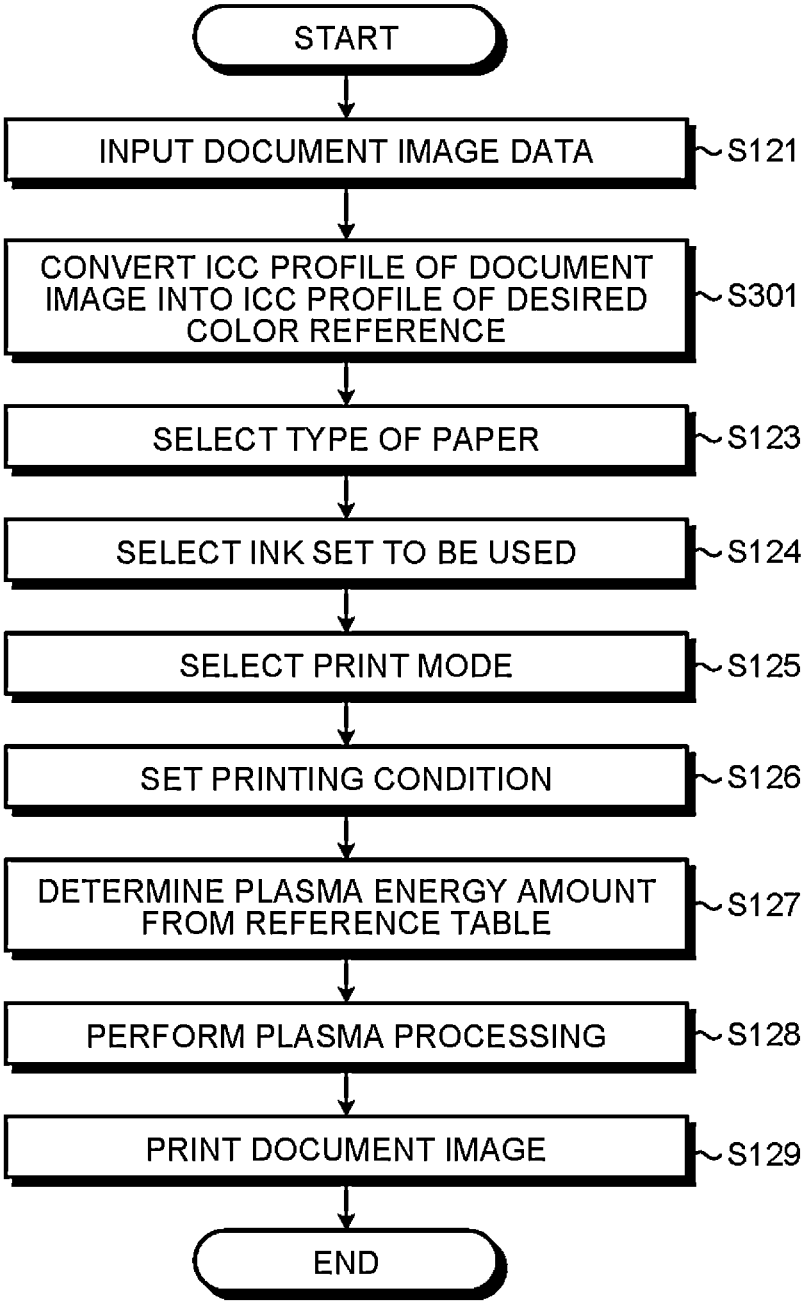
FIG. 22 is a flow chart illustrating yet another example of the printing operation according to the first embodiment.

FIG. 22 is a flow chart illustrating yet another example of the printing operation according to the first embodiment. As illustrated in FIG. 22, in the printing operation, first, the control unit 160 inputs document image data from outside in the same manner as in step S121 in FIG. 20. However, the ICC profile of the document image data input in the present operation is not an ICC profile of desired color reference.

Subsequently, the control unit 160 converts the ICC profile of the input document image data into an ICC profile of desired color reference (step S301). As a specific example, the control unit 160 converts, for example, color information using a Euroscale ICC profile into an ICC profile of Japan color. Also in this case, the RIP that generates raster data is mounted in the printing apparatus (system) 1.

Thereafter, the control unit 160 sets the type of paper, the use ink set, the print mode, and the printing condition, determines the plasma energy amount from the reference table, and performs the plasma processing and the printing of the document image by performing the same operation as that of steps S123 to S129 in FIG. 20, and then ends the present operation. However, the size of droplet used in the printing of the document image in step S129 is the size of droplet determined from the ICC profile converted in step S301. Therefore, the plasma energy amount determined in step S127 is the plasma energy amount according to the size of droplet determined from the ICC profile.

Figure 23:
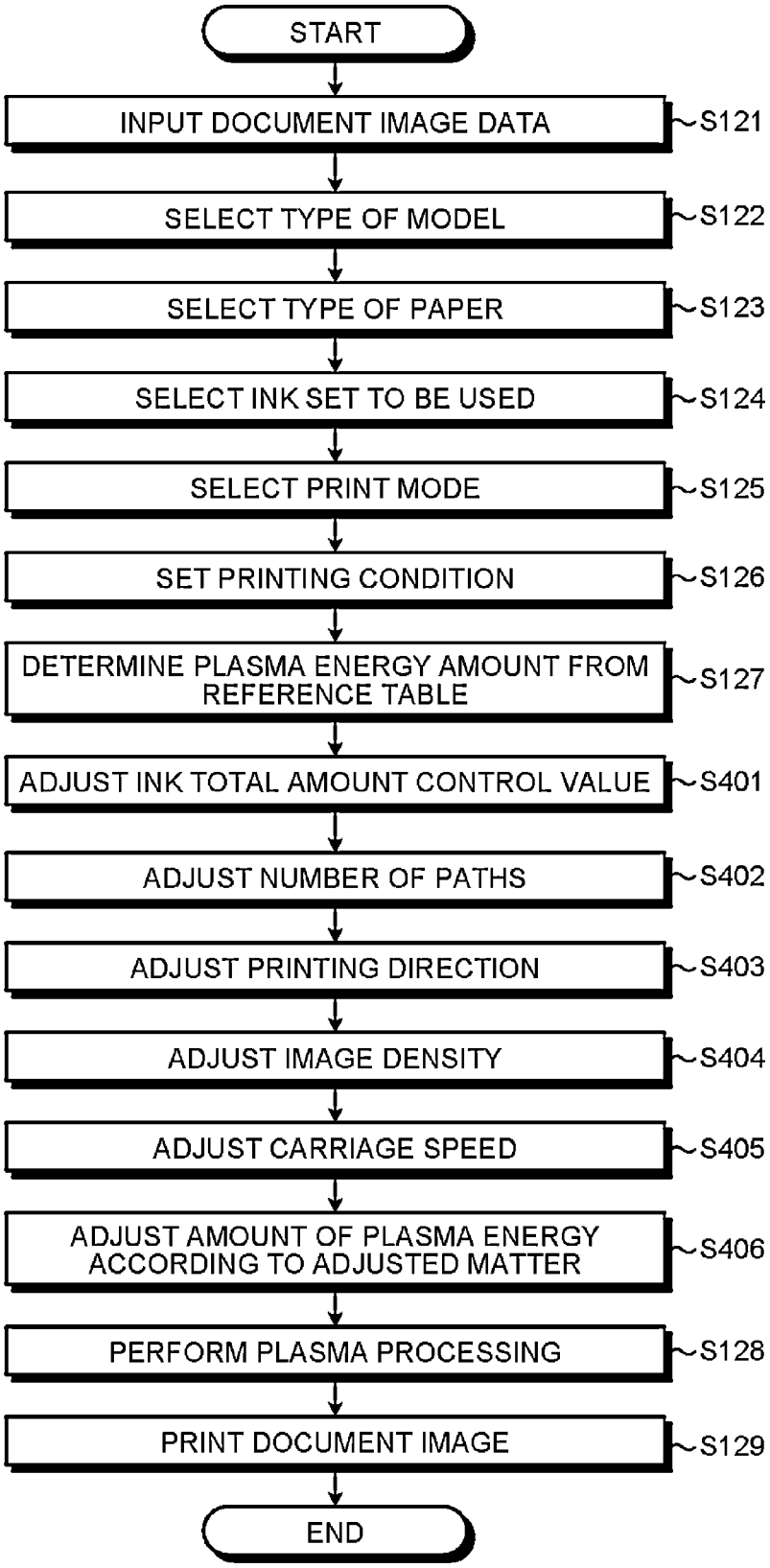
FIG. 23 is a flow chart illustrating yet another example of the printing operation according to the first embodiment.

FIG. 23 is a flow chart illustrating yet another example of the printing operation according to the first embodiment. As illustrated in FIG. 23, in the printing operation, in the same manner as in steps S121 to S127 in FIG. 20, first, the control unit 160 inputs document image data, sets the type of model, the type of paper, the use ink set, the print mode, and the printing condition, and determines the plasma energy amount from the reference table according to the above settings.

Subsequently, the control unit 160 adjusts the set printing condition. For example, the control unit 160 adjusts an ink total amount control value (step S401), the number of paths (step S402), the printing direction (step S403), the image density (step S404), the carriage speed (step S405), and the like. Specifically, for example, the control unit 160 provides options of each setting item in FIGS. 24 to 28 to a user and modifies a setting value of each setting item according to a selected option. FIG. 24 is an adjustment table for the ink total amount control value. FIG. 25 is an adjustment table for the number of paths. FIG. 26 is an adjustment table for the printing direction. FIG. 27 is an adjustment table for the image density. FIG. 28 is an adjustment table for the carriage speed.

Subsequently, the control unit 160 adjusts the plasma energy amount determined in step S127 by a plasma energy amount coefficient associated with each adjusted matters in FIGS. 24 to 28 according to the adjustments in stets S401 to S405 (step S406). For example, when the ink total amount control value is adjusted to "low" in step S401, the control unit 160 multiplies a plasma energy amount E by a plasma energy amount coefficient (=0.9 times) associated with the ink total amount control value "low", so that the control unit 160 calculates the adjusted plasma energy amount (0.9E). In this case, when there is a plurality of adjustment items, the plasma energy amount determined in step S127 may be multiplied by all of the plasma energy amount coefficients of the adjustment items.

Thereafter, the control unit 160 performs the plasma processing by using the plasma energy amount adjusted in step S406 (step S128), performs printing of the document image (step S129), and ends the present operation.

In the creation/optimization and distribution processing of the reference table described with reference to FIG. 15 in the above description, an initial plasma energy amount is determined by using the table illustrated in FIG. 17. However, it is not limited to this method. For example, the first plasma energy amount is set to a minimum value and the plasma energy amount may be gradually increased based on an analysis result of the obtained dot image of test pattern.

When the plasma energy amount is gradually increased from the minimum value, the plasma energy amount applied to each of discharge electrode 111 to 116 in FIG. 14 may be changed to be gradually increased from the downstream side or the conveyance speed of the processing object 20, that is, the circulation speed of the dielectric 121, may be changed.

Figure 29:
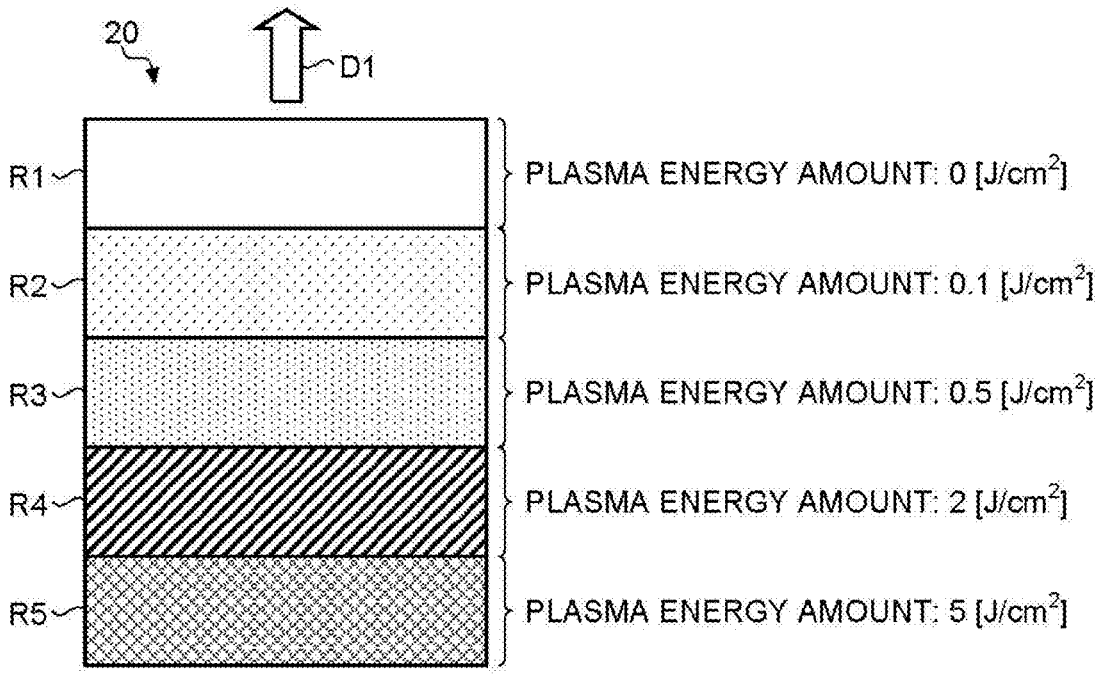
FIG. 29 is a diagram illustrating an example of a processing object which is plasma-processed by using a different plasma energy amount for each region in the first embodiment.

As a result, in step S106 in FIG. 15, as illustrated in FIG. 29, it is possible to obtain the processing object 20 in which each region is plasma-processed with a different plasma energy amount. In FIG. 29, the region R1 is a region that is not plasma-processed (the plasma energy amount=0 J/cm$^2$), the region R2 indicates a region that is plasma-processed with a plasma energy amount of 0.1 J/cm$^2$, the region R3 indicates a region that is plasma-processed with a plasma energy amount of 0.5 J/cm$^2$, the region R4 indicates a region that is plasma-processed with a plasma energy amount of 2 J/cm$^2$, and the region R5 indicates a region that is plasma-processed with a plasma energy amount of 5 J/cm$^2$.

Figure 30:
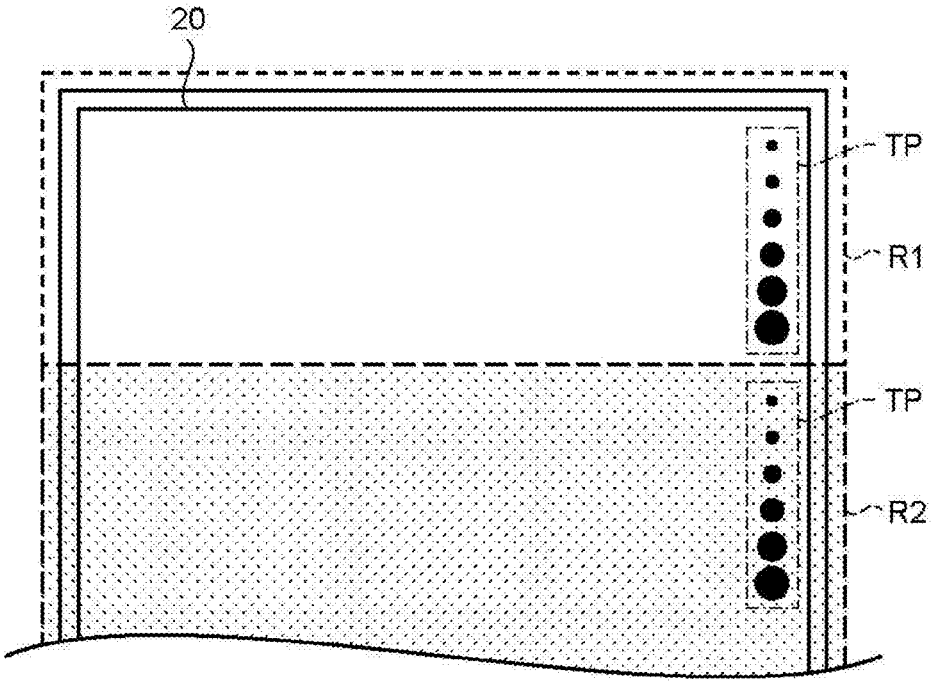
FIG. 30 is a diagram illustrating an example of a test pattern formed on the processing object illustrated in FIG. 29.

On the processing object 20 in which each region is plasma-processed with a different plasma energy amount as illustrated in FIG. 29, for example, a common test pattern TP including a plurality of dots having different dot diameters as illustrated in FIG. 30 may be formed in each region R1 to R5 in step S107 in FIG. 15.

Figure 31:
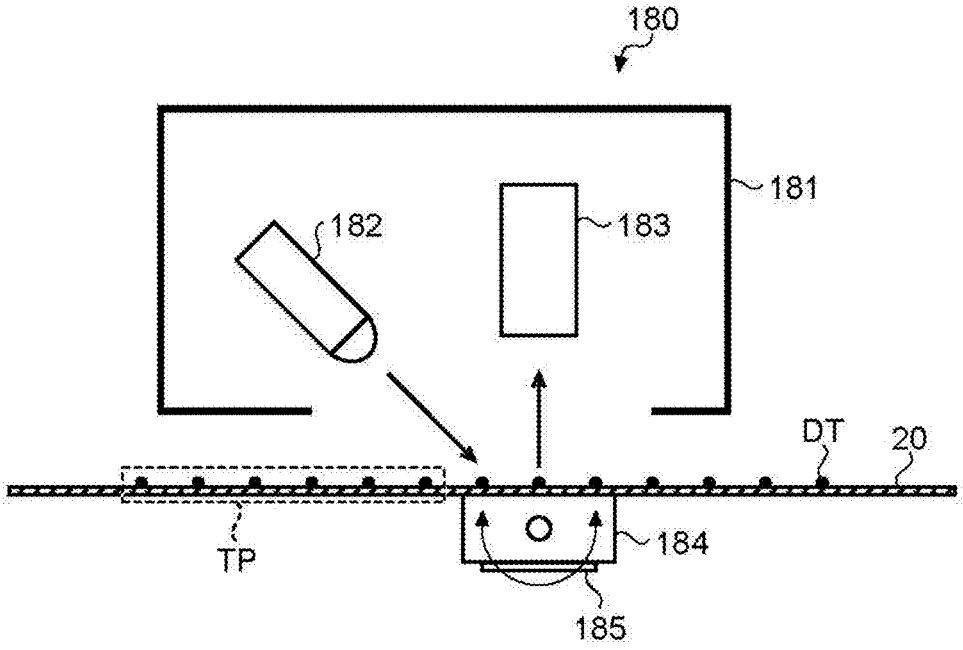
FIG. 31 is a schematic diagram illustrating an example of the pattern reading unit according to the first embodiment.

The test pattern TP formed as described above is read by the pattern reading unit 180 in FIG. 14 in step S108 in FIG. 15. FIG. 31 illustrates an example of the pattern reading unit 180 according to the embodiment.

As illustrated in FIG. 31, for example, a reflection type two-dimensional sensor including a light emitting unit 182 and a light receiving unit 183 is used as the pattern reading unit 180. The light emitting unit 182 and the light receiving unit 183 are arranged in a housing 181 arranged on a dot forming side of the processing object 20. An opening portion is provided in a side of the housing 181 facing the processing object 20 and light emitted from the light emitting unit 182 is reflected by the surface of the processing object 20 and enters the light receiving unit 183. The light receiving unit 183 forms an image of reflected light amount (reflected light intensity) reflected by the surface of the processing object 20. The light amount (intensity) of the reflected light formed into an image varies between a portion including printing (dot DT of the test pattern TP) and a portion including no printing, so that it is possible to detect the shape of the dot and the image density in the dot on the basis of the reflected light amount (reflected light intensity) detected by the light receiving unit 183. The configuration of the pattern reading unit 180 and the detection method of the pattern reading unit 180 can be variously changed as long as the pattern reading unit 180 can detect the test pattern TP printed on the processing object 20.

The pattern reading unit 180 may include a reference pattern display unit 184 including a reference pattern 185 as a means of calibrating a light amount of the light emitting unit 182 and a reading voltage of the light receiving unit 183. The reference pattern display unit 184 has a rectangular parallelepiped shape formed by, for example, a predetermined processing object (for example, plain paper) and the reference pattern 185 is attached to one surface of the rectangular parallelepiped. When the calibration of the light emitting unit 182 and the light receiving unit 183 is performed, the reference pattern display unit 184 rotates so that the reference pattern 185 faces the light emitting unit 182 and the light receiving unit 183, and when the calibration is not performed, the reference pattern display unit 184 rotates so that the reference pattern 185 does not face the light emitting unit 182 and the light receiving unit 183. The reference pattern 185 may have, for example, the same shape as that of the test pattern TP illustrated in FIG. 30.

In the embodiment, a case is illustrated where the plasma energy amount is adjusted based on the analysis result of the dot image acquired by using the pattern reading unit 180. However, it is not limited to this. For example, it may be configured so that a user sets the plasma energy amount based on the test pattern TP that is formed on the plasma-processed processing object 20 in step S107 in FIG. 15.

Figure 32:
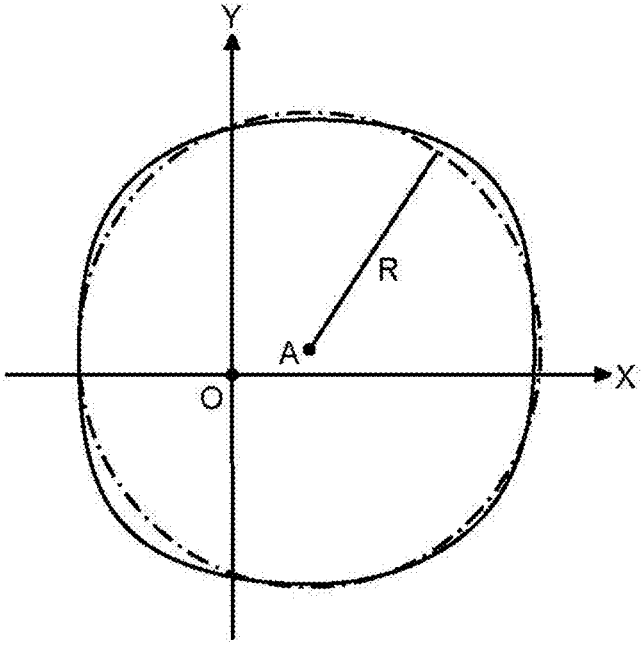
FIG. 32 is a diagram illustrating an example of a captured image of a dot (a dot image) acquired in the first embodiment.

Next, an example of a determination method of the size of dot in the test pattern formed on the processing object 20 will be described with reference to the drawings. To determine the size of dot in the test pattern, the test pattern TP as illustrated in FIG. 30 is recorded on the plasma-processed processing object 20 and images of the test pattern TP and the reference pattern 185 are captured by the pattern reading unit 180, so that a captured image of a dot (a dot image) as illustrated in FIG. 32 is acquired. It is assumed that the position of the reference pattern 185 in the entire image capturing area of the light receiving unit 183 illustrated in FIG. 31 (the entire image capturing area of the two-dimensional sensor) is known in advance by measurement. The control unit 160 performs calibration for the dot image of the test pattern TP by comparing a pixel of the dot image of the acquired test pattern TP and a pixel of the dot image of the reference pattern 185. In this case, for example, as illustrated in FIG. 32, there is a circle-like figure, which is not a perfect circle, (for example, a contour portion (solid line) of a dot of the test pattern TP) and the circle-like figure is fitted by a true circle (a contour portion (dot and dash line) of a dot of the reference pattern 185). In this fitting, a least-squares method is used.

Figure 33:
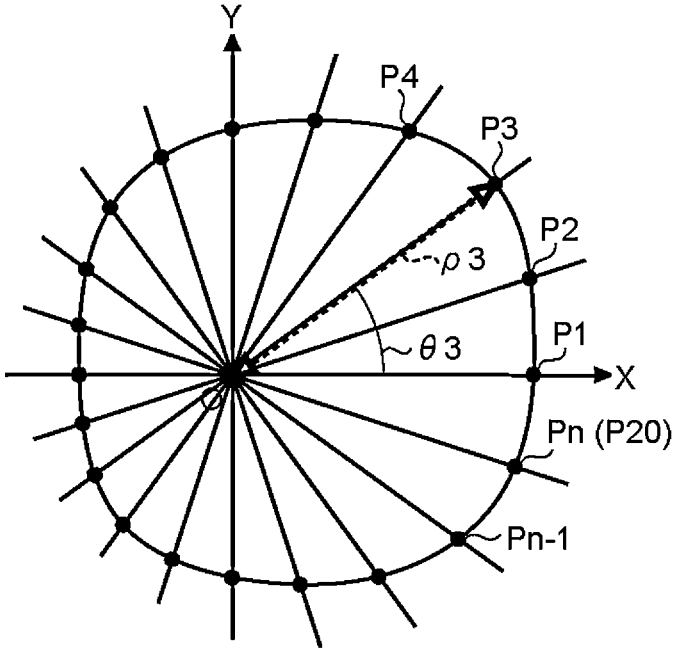
FIG. 33 is a diagram for explaining a flow of applying a least square method to the captured image illustrated in FIG. 32.

As illustrated in FIG. 33, in the least-squares method, to calculate a deviation between the circle-like figure (solid line) and the true circle (dot and dash line), an origin O is defined at a roughly center position, an XY coordinate system based on the origin O is set, and finally an optimal center point A (coordinates (a, b)) and the radius R of the true circle are obtained. Therefore, first, the circumference ($2\pi$) of the circle-like figure is uniformly divided based on an angle and then for each of data points P1 to Pn obtained by the division, an angle $\theta i$ with respect to the X axis and a distance $\rho i$ from the origin O are obtained. Here, when the number of the data points (that is, the number of data sets) is "N", the following formula (1) can be derived from a relation of trigonometric function.

$$x_i=\rho_i \cos \theta_i$$

$$y_i=\rho_i \sin \theta_i \tag{1}$$

At this time, the optimal center point A (coordinates (a, b)) and the radius R of the true circle are given by the following formula (2).

$$R = \frac{\sum_{i=1}^{N} \rho_i}{N} \tag{2}$$

$$a = \frac{2\sum_{i=1}^{N} x_i}{N}$$

$$b = \frac{2\sum_{i=1}^{N} y_i}{N}$$

In this way, the dot image of the reference pattern 185 is read and the calibration is performed by comparing the diameter of the dot calculated by the aforementioned least-squares method with the diameter of the reference chart. After the calibration, the dot image printed in a pattern is read and the diameter of the dot is calculated.

In general, the circularity is represented by a difference between the radiuses of two concentric geometric circles when the circle-like figure is sandwiched by the two concentric circles and a distance between the concentric circles becomes minimum. However, the ratio of minimum diameter/maximum diameter of the concentric circles can be defined as the circularity. In this case, when the value of minimum diameter/maximum diameter is "1", it means that the circle-like figure is a true circle. This circularity can also be calculated by the least-squares method by obtaining the dot image.

The maximum diameter can be obtained as a maximum distance of distances between a dot center of the obtained image and each point on the circumference of the dot. On the other hand, the minimum diameter can be calculated as a minimum distance of distances between the dot center and each point on the circumference of the dot.

The dot diameter and the circularity of the dot vary depending on the color or the type of used ink and a permeation state of the ink into the processing object 20. In the embodiment, the quality of image is improved by controlling the dot shape (the circularity) and the dot diameter to be targeted values according to the color or the type of used ink, the type of the processing object 20, and the discharge amount of ink. Further, in the embodiment, a high quality image is achieved by adjusting the plasma energy amount in the plasma processing so that the dot diameter per amount of ink discharge becomes a target dot diameter by reading a formed image and analyzing the image.

In the embodiment, it is possible to detect the pigment density in a dot based on the light amount of the reflected light, so that an image of a dot is taken and the density in the dot is measured. The density unevenness is measured by calculating the density values as variation distribution by statistical calculation. Further, it is possible to prevent the mixture of pigment due to merge of dots by selecting the plasma energy amount so as to minimize the calculated density unevenness, and thereby it is possible to achieve a higher quality image. Regarding whether to give priority to the control of the dot diameter, the suppression of the density unevenness, or the improvement of the circularity, it is possible to configure so that a user can switch modes according to a desired image quality.

As described above, in the embodiment, the plasma energy amount is controlled according to the color or the type of the ink so that the unevenness of the circularity of dot or the unevenness of pigment in a dot is reduced or the dot diameter becomes a target size. Thereby, it is possible to provide high quality printed matter while realizing homogenization of dot diameters and saving energy. Even when the characteristics of the processing object 20 is changed or the printing speed is changed, it is possible to perform stable plasma processing, so that it is possible to stably realize good image recording.

In the embodiment described above, a case is described where the plasma processing is mainly performed on the processing object. As described above, when the plasma processing is performed, the wettability of ink with respect to the processing object is improved. As a result, a dot to be attached during ink jet recording spreads, so that an image different from an image printed on an unprocessed processing object may be recorded. Therefore, when printing on a plasma-processed recording medium, it is possible to perform the printing by, for example, reducing the size of ink droplet by lowering the discharge voltage of ink when performing the ink jet recording. As a result, the size of ink droplet can be reduced, so that cost down can be achieved.

Figure 34:
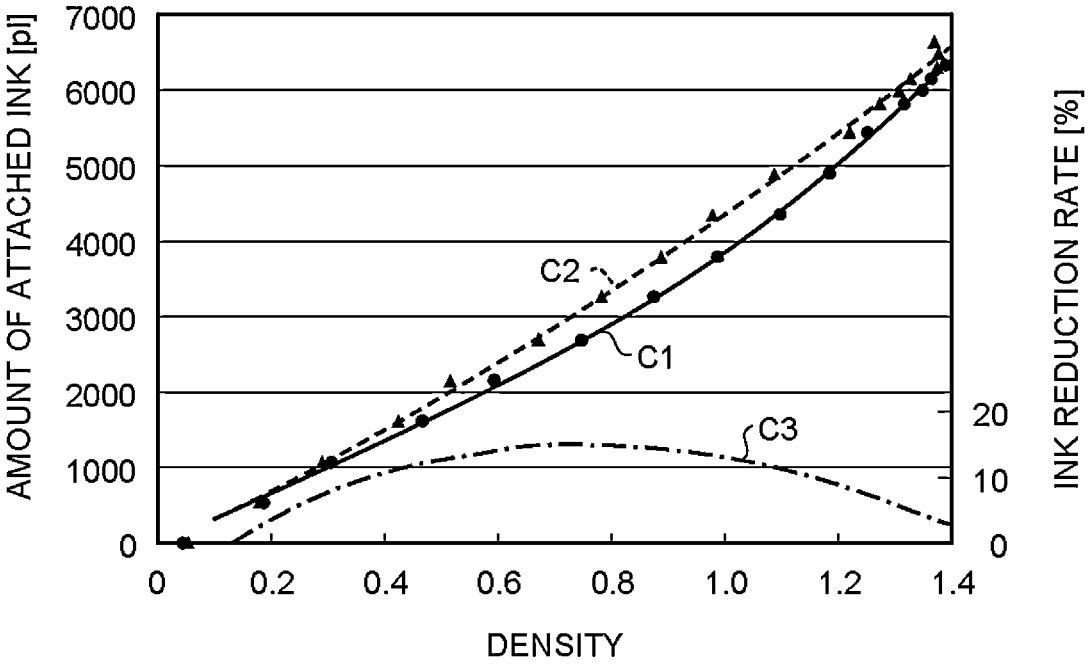
FIG. 34 is a graph illustrating a relationship between an ink discharge amount and an image density according to the first embodiment.

FIG. 34 is a graph illustrating a relationship between the ink discharge amount and the image density according to the embodiment. In FIG. 34, the solid line C1 indicates a relationship between the ink discharge amount and the image density when the plasma processing according to the embodiment is performed and the dashed line C2 indicates a relationship between the ink discharge amount and the image density when the ink jet recording processing is performed on the processing object 20 to which the plasma processing according to the embodiment is not applied. Further, the dot and dash line C3 indicates an ink reduction rate of the solid line C1 with respect to the dashed line C2.

As known from the comparison between the solid line C1 and the dashed line C2 in FIG. 34 and the dot and dash line C3, when the plasma processing according to the embodiment described above is applied to the processing object 20 before the ink jet recording processing, the ink discharge amount required to obtain the same image density is reduced by the effects such as the improvement of the circularity of dot, the enlargement of dot, and the homogenization of the pigment density in a dot.

Further, when the plasma processing according to the embodiment described above is applied to the processing object 20 before the ink jet recording processing, the thickness of the pigment attached to the processing object 20 is reduced, so that it is possible to obtain the effects of improvement of chroma and enlargement of color gamut. Further, as a result of reduction of the amount of ink, the energy for drying the ink can also be reduced, so that it is possible to obtain a power saving effect.

According to the present embodiments, it is possible to provide a printing apparatus, a printing system, and a manufacturing method of printed matter, which can manufacture high-quality printed matter.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing apparatus comprising:

a plasma processing unit that processes a surface of a processing object by using plasma;

a recording unit that performs ink jet recording on the surface of the processing object, which has been plasma-processed by the plasma processing unit;

a setting unit that sets a print mode of an image to be recorded by the recording unit, the print mode corresponding to the processing object; and a control unit that controls the plasma processing unit to plasma-process the processing object with a plasma energy amount based on the print mode set by the setting unit.

2. The printing apparatus according to claim 1, wherein the print mode includes at least one of color or monochrome, a size of droplet, an average production speed of the printing apparatus, and a resolution.

3. The printing apparatus according to claim 1, wherein the setting unit further sets an ink set used to print the image to be recorded, the ink set corresponding to the processing object, and the control unit identifies the plasma energy amount based on the print mode and the ink set that are set by the setting unit, and controls the plasma processing unit to plasma-process the processing object with the identified plasma energy amount.

4. The printing apparatus according to claim 1, further comprising:

an input unit that inputs the image to be recorded; and a conversion unit that converts color information of the input image to be recorded by using a desired ICC profile, wherein the control unit sets a plasma energy amount according to a size of droplet of the ink based on the ICC profile converted by the conversion unit as the plasma energy amount of the plasma processing unit.

5. The printing apparatus according to claim 4, wherein the input unit is a personal computer, a scanner, or a camera.

6. The printing apparatus according to claim 4, wherein the input unit inputs the image to be recorded, and the conversion unit converts an ICC profile of the image to be recorded into the desired ICC profile.

7. The printing apparatus according to claim 1, wherein the setting unit further sets at least one of an ink total amount control value, a number of paths, a printing direction, an image density, and a carriage speed as a condition to print the image to be recorded on the processing object, and the control unit identifies the plasma energy amount on the basis of at least one of the print mode, the ink total amount control value, the number of paths, the printing direction, the image density, and the carriage speed that are set by the setting unit and controls the plasma processing unit to plasma-process the processing object with the identified plasma energy amount.

8. The printing apparatus according to claim 7, further comprising:

an adjustment unit that adjusts the at least one of the ink total amount control value, the number of paths, the printing direction, the image density, and the carriage speed which are set as the condition to print the image to be recorded on the processing object, wherein the control unit identifies the plasma energy amount based on the at least one of the print mode, the ink total amount control value, the number of paths, the printing direction, the image density, and the carriage speed, which are set by the setting unit and adjusted by the adjustment unit, and controls the plasma processing unit to plasma-process the processing object with the identified plasma energy amount.

9. The printing apparatus according to claim 1, wherein the plasma processing unit includes at least one discharge electrode that generates the plasma, and the control unit controls the plasma processing unit to plasma-process the processing object with the plasma energy amount based on the print mode set by the setting unit by adjusting a voltage value of a voltage pulse to be applied to the at least one discharge electrode or adjusting the number of discharge electrodes to which the voltage pulse is to be applied.

10. The printing apparatus according to claim 1, wherein the plasma processing unit acidifies at least the surface of the processing object.

11. The printing apparatus according to claim 1, wherein an ink used by the recording unit is an ink in which negatively charged pigment is dispersed in a liquid.

12. The printing apparatus according to claim 1, wherein an ink used by the recording unit is an aqueous pigment ink.

13. A printing system including a plasma processing apparatus that processes a surface of a processing object by using plasma and a recording apparatus that performs ink jet recording on the surface of the processing object, which has been plasma-processed by the plasma processing apparatus, the printing system comprising:

a setting unit that sets a print mode of an image to be recorded by the recording apparatus, the print mode corresponding to the processing object; and a control unit that controls the plasma processing apparatus to plasma-process the processing object with a plasma energy amount based on the print mode set by the setting unit.

14. A manufacturing method of printed matter, which is to manufacture printed matter where an image is formed on a processing object by an ink jet recording method, the manufacturing method comprising:

setting a print mode of an image to be recorded, the print mode corresponding to the processing object;

plasma-processing the processing object with a plasma energy amount based on the set print mode; and printing the image to be recorded on the plasma-processed processing object.

* * * * *